US005933119A

United States Patent [19]

Fujii et al.

[11] Patent Number: 5,933,119

[45] Date of Patent: Aug. 3, 1999

[54] GLASS ANTENNA SYSTEM FOR VEHICLES

[75] Inventors: Hiroyuki Fujii; Mitsuhisa Maegawa, both of Mie, Japan

[73] Assignee: Central Glass Company Limited, Yamaguchi, Japan

[21] Appl. No.: 09/026,525

[22] Filed: Feb. 20, 1998

[30] Foreign Application Priority Data

| | | | |
|---|---|---|---|
| Feb. 20, 1997 | [JP] | Japan | 9-036746 |
| Feb. 25, 1997 | [JP] | Japan | 9-041091 |
| Mar. 31, 1997 | [JP] | Japan | 9-080191 |

[51] Int. Cl.[6] ..... H01Q 1/32

[52] U.S. Cl. ..... 343/713; 343/704

[58] Field of Search ..... 343/713, 704; H01Q 1/32

[56] References Cited

U.S. PATENT DOCUMENTS

| | | | |
|---|---|---|---|
| 4,967,202 | 10/1990 | Shinnai et al. | 343/713 |
| 5,099,250 | 3/1992 | Paulus et al. | 343/713 |
| 5,231,410 | 7/1993 | Murakami et al. | 343/713 |
| 5,334,989 | 8/1994 | Nagayama et al. | 343/713 |

FOREIGN PATENT DOCUMENTS

| | | | |
|---|---|---|---|
| 56-42401 | 4/1981 | Japan . | |
| 62-123803 | 6/1987 | Japan . | |
| 3-85004 | 4/1991 | Japan . | |
| 6-104619 | 4/1994 | Japan | H01Q 1/32 |
| 6-140821 | 5/1994 | Japan | H01Q 1/32 |
| 6-177625 | 6/1994 | Japan | H01Q 1/32 |

*Primary Examiner*—Don Wong
*Assistant Examiner*—Hoang Nguyen
*Attorney, Agent, or Firm*—Evenson, McKeown, Edwards & Lenahan, P.L.L.C.

[57] ABSTRACT

There is provided a glass antenna system which is attached to a vehicle rear window glass for receiving FM and AM radio broadcast waves. The glass antenna system comprises a defogging heater element disposed on the rear window glass in a way as to leave a space therearound. The defogging heater element includes a plurality of heating strips and a pair of bus bars. The glass antenna system further comprises an antenna having a feed point disposed in a widthwise marginal area of said space under the heater element, a first vertical conductive strip disposed in an area of said space between one of the bus bars and a lateral edge of the window glass and connected at a lower end thereof to the feed point, a horizontal conductive strip disposed in an area of the space above the heater element and connected at one of opposite ends thereof to an upper end of the first vertical conductive strip, and a second vertical conductive strip connected at an upper end thereof to the other of the opposite ends of the horizontal conductive strip and extending downwardly therefrom in a way as to intersect at right angles while being electrically connected to the heating strips.

53 Claims, 15 Drawing Sheets

GLASS ANTENNA SYSTEM FOR VEHICLES

BACKGROUND OF THE INVENTION

1. Field of the Invention

The present invention relates to a glass antenna attached to a rear window glass of a vehicle such as an automobile for reception of AM radio broadcast waves, FM radio broadcast waves and TV broadcast waves, and particularly to such a kind which is suited for reception of FM radio broadcast waves and AM radio broadcast waves.

2. Description of the Related Art

In order that the sight of the driver is not obstructed by a glass antenna, it is a usual practice to attach the antenna not to a windshield but to a vehicle rear window. In recent years, a number of glass antennas for FM radio broadcast waves and glass antennas for AM radio broadcast waves have been proposed and a number of applications relating to such glass antennas have been filed. One of them is a glass antenna including a conductive strip perpendicular to heating strips of a defogging heater element and connected to same and another one is a glass antenna including an antenna element which is disposed in a space above the heater element and has a portion disposed so as to intersect at right angles the heating strips of the heater element while being connected to same, those antennas being disclosed in JP 56-42401. Another one of them is a glass antenna including a vertical conductive strip extending along a bus bar of a defogging heater element and a short horizontal strip disposed in a space above the defogging heater element, this kind of antenna being disclosed in JP 62-123803 and JP 3-85004 which were assigned to the same assignee of this application.

However, the gain of the glass antenna disclosed in JP 56-42401 in receiving FM radio broadcast waves is not sufficiently large considering the fact that it occupies almost all of the space above the defogging heater element, though the antenna can attain a certain measure of gain in receiving AM radio broadcast waves.

Further, the glass antenna disclosed in JP 62-123803 occupies only a small area of the space above the defogging heater element but is incapable of attaining a sufficiently large reception gain in receiving broadcast waves in a considerably wide band extending from AM radio broadcast band to TV broadcast band.

SUMMARY OF THE INVENTION

According to an aspect of the present invention, there is provided a novel and improved glass antenna system which is attached to a vehicle rear window glass for receiving FM and AM radio broadcast waves. The glass antenna system comprises a defogging heater element disposed on the rear window glass in a way as to leave a space therearound. The defogging heater element includes a plurality of heating strips and a pair of bus bars. The glass antenna system further comprises an antenna having a feed point disposed in a widthwise marginal area of the space under the heater element, a first vertical conductive strip disposed in an area of the space between one of the bus bars and a lateral edge of the window glass and connected at a lower end thereof to the feed point, a horizontal conductive strip disposed in an area of the space above the heater element and connected at one of opposite ends thereof to an upper end of the first vertical conductive strip, and a second vertical conductive strip connected at an upper end thereof to the other of the opposite ends of the horizontal conductive strip and extending downwardly therefrom while intersecting at right angles and being electrically connected to the heating strips, or the glass antenna system further comprises an antenna having a feed point disposed in a widthwise marginal area of the space above the heater element, a first vertical conductive strip disposed in an area of the space between one of the bus bars and a lateral edge of the window glass and connected at an upper end thereof to the feed point, a horizontal conductive strip disposed in an area of the space under the heater element and connected at one of opposite ends thereof to a lower end of the first vertical conductive strip, and a second vertical conductive strip connected at a lower end thereof to the other of the opposite ends of the horizontal conductive strip and extending upwardly therefrom while intersecting at right angles and being electrically connected to the heating strips. By this, the first vertical conductive strip is capacitively coupled with one of the bus bars between which the heating strips are located, and the second vertical conductive strip intersects at right angles while being electrically connected to the heating strips, whereby the vertical conductive strips can efficiently pick up and collect the radio waves entering the heating strips. Further, the horizontal conductive strips connects between the first and second vertical conductive strips to make phase adjustment thereof, and the total length of the antenna is set nearly equal to the resonance length with a view to making higher the gain of the antenna of itself. By the above, the gains of the glass antenna system in receiving FM radio broadcast waves and AM radio broadcast waves are made higher to such an extent as to exceed the level of the conventional glass antenna system and even the whip antenna.

In this specification, the term "vertical" is used in the sense of "directed upwardly and downwardly" on the window glass, so that a vertical element or strip is not always literally vertical.

The glass antenna system may further comprise an auxiliary element connected to one of the heating strips, an auxiliary element connected to one of the bus bars, an auxiliary element connected to the horizontal conductive strip disposed in an area of the space above the defogging heater element, an auxiliary element connected to the horizontal conductive strip disposed in an area of the space under the defogging heater element, or an additional element or elements intersecting the heating strips at right angles.

Further, it is preferable that the distance between the first vertical conductive strip and the adjacent bus bar ranges from 1 mm to 10 mm since they can be capacitively coupled with each other.

Further, it is preferable that the distance between the bus bars and an adjacent metallic vehicle body portion is equal to or larger than 5 mm for reception of FM radio broadcast waves in the band of 76–90 MHz in Japan and equal to or larger than 10 mm for reception of FM radio broadcast waves in the band of 88–108 MHz in North America, Europe, etc., since this enables the glass antenna system to attain a higher gain than that of a whip antenna.

Further, the high frequency coil incorporated in the DC power circuit can be reduce leakage current leaked to the metallic vehicle body in receiving FM radio broadcast waves. The choke coil incorporated in the DC power circuit can be reduce leakage current leaked to the metallic body in receiving Am radio broadcast waves.

The glass antenna system of this invention is particularly useful and effective in case the metallic vehicle body and the adjacent bus bar are more distant from each other than a predetermined amount.

The gains of the glass antenna system shown in FIG. 1, which will be described in detail hereinlater, in receiving FM radio broadcast waves vary with the distant between the bus bar and the panel flange constituting the end potion of the metallic vehicle body. Such variable gains with that distance were measured, and the result as shown in FIG. 25 was obtained. From this graph, it will be seen that in case the diversity reception is carried out with the glass antenna system of this invention as a subsidiary antenna and another antenna such as a whip antenna as a main antenna, the glass antenna system of this invention is sufficiently useful for receiving broadcast waves in either of the band of 76–90 MHz and the band of 88–108 MHz if the distance between the metallic vehicle body and the adjacent bus bar is about 3 mm or larger.

However, in case the glass antenna system of this invention is used alone or used as a main antenna of a diversity antenna system, it is required that the gain of the glass antenna system of this invention is nearly equal to that of a whip antenna. When this is the case, FM radio broadcast waves can be received suitably and desirably if the distance between the bus bar and the metallic vehicle body is set to 5 mm or more in case the received waves are in the band of 76–90 MHz and 10 mm or more in case of the received waves are in the band of 88–108 MHz.

Further, by making the bus bars apart from the metallic body by the above described distance, it becomes possible to reduce the reactive capacitance between the bus bar and the metallic vehicle body in receiving AM radio broadcast and thereby reduce leaked radio waves.

While the feed point is preferably disposed in a widthwise marginal area of the space above or under the defogging heater element, it may be disposed at or adjacent the widthwise central area of the space on consideration of its arrangement restriction and the workability at the time of work for connection with a lead wire or the like.

It is preferable that the distance between the first vertical conductive strip and the adjacent bus bar ranges from 1 to 10 mm so that the first vertical conductive strip is capacitively coupled with the bus bar since such an arrangement makes higher the gain of the glass antenna system.

It will suffice to dispose, on consideration of the total length of the first vertical conductive strip and the horizontal conductive strip, the second vertical conductive strip nearly at the widthwise central portion of the window glass so as to extend vertically while intersecting at right angles and being electrically connected to the heating strips. However, it is preferable that the total length of the first vertical conductive strip, the horizontal conductive strip and the second vertical conductive strip is set to $n\lambda\alpha/4$ where n is an integer and usually 2, $\alpha$ is wavelength contraction ratio and about 0.7 in receiving FM radio broadcast waves and about 0.65 in receiving TV broadcast waves, and $\lambda$ is wavelength of radio wave to be received, i.e., set so as to be nearly within the range from 900 to 1500 mm in receiving FM radio broadcast waves.

The auxiliary element connected to the heating strip or bus bar is very effective in some kinds of cars since it can vary the received frequency band. That is, the peak of the reception gain can be shifted or moved. The auxiliary element connected to some part of the glass antenna system of this invention, particularly to the horizontal conductive strip disposed in an area of the space above or under the heater element and the auxiliary element intersecting the heating strips at right angles can make higher the reception gain or improve the frequency characteristic in some kinds of cars.

While the glass antenna system of this invention can be used alone or independently to achieve an intended end, it can naturally be used together with another antenna attached to the rear window glass, an antenna attached to a windshield, an antenna attached to a side window or a pole or rod antenna such as a whip antenna to carry out diversity reception.

According to another aspect of the present invention, there is provided a glass antenna system attached to a vehicle rear window glass for receiving FM and AM radio broadcast waves, comprising a defogging heater element disposed on the rear window glass in a way as to leave a space therearound, the defogging heater element including a plurality of heating strips and a pair of bus bars, and an antenna having a feed point disposed in a widthwise marginal area of the space under the heater element, a first vertical conductive strip disposed in an area of the space between one of the bus bars and a lateral edge of the window glass and connected at a lower end thereof to the feed point, a horizontal conductive strip disposed in an area of the space under the heater element and connected at one of opposite ends thereof to the feed point, and a second vertical conductive strip having a lower end connected to the other of the opposite ends of the horizontal conductive strip and extending upwardly therefrom while intersecting at right angles and being electrically connected to the heating strips, or an antenna having a feed point disposed in a widthwise marginal area of the space above the heater element, a first vertical conductive strip disposed in an area of the space between one of the bus bars and a lateral edge of the window glass and connected at an upper end thereof to the feed point, a horizontal conductive strip disposed in an area of the space above said heater element and connected at one of opposite ends thereof to the feed point, and a second vertical conductive strip having an upper end connected to the other of the opposite ends of the horizontal conductive strip and extending downwardly therefrom while intersecting at right angles and being electrically connected to the heating strips. In this instance, it is preferable that the total length of the second vertical conductive strip and the horizontal conductive strip (the total length includes the length of an auxiliary element connected to the second vertical conductive strip) is set to $n\lambda\alpha/4$ where n is an integer and preferably 1 or 2, $\alpha$ is wavelength contraction ratio and about 0.7 in receiving FM radio broadcast waves and about 0.65 in receiving TV broadcast waves, and $\lambda$ is wavelength of radio wave to be received, i.e., set so as to be nearly within the range from 400 to 700mm or 900 to 1400 mm in receiving FM radio broadcast waves.

According to a further aspect of the present invention, there is provided a glass antenna system attached to a vehicle rear window glass for receiving FM and AM radio broadcast waves, comprising a defogging heater element disposed on the rear window glass in a way as to leave a space therearound, the defogging heater element including a plurality of heating strips and a pair of bus bars, and an antenna having a first vertical conductive strip disposed in an area of the space between one of the bus bars and a lateral edge of the window glass, a first horizontal conductive strip disposed in an area of the space above the heater element and connected at one of opposite ends thereof to an upper end of said first vertical conductive strip, a second horizontal conductive strip disposed in an area of the space under the heater element and connected at one of opposite ends thereof to a lower end of the first vertical conductive strip, a second vertical conductive strip having an upper end connected to the other of the opposite ends of the first horizontal conductive strip and a lower end connected to the other of the opposite ends of the second horizontal conductive strip, the second vertical conductive strip extending vertically in a way as to intersect at right angles while being electrically connected to the heating strips, and a feed point connected to at least one of the first vertical conductive strip, first horizontal conductive strip, second vertical conductive strip and second horizontal conductive strips. In this instance, it is preferable that the total length of the first and second vertical conductive strips and the first and second horizontal conductive strips (i.e., the total length of the looped antenna) is set to $n\lambda\alpha/4$ where n is an integer and preferably 3, $\alpha$ is wavelength contraction ratio and about 0.7 in receiving FM radio broadcast waves and about 0.65 in receiving TV broadcast waves, and $\lambda$ is wavelength of radio wave to be received, i.e., set so as to be nearly within the range from 1400 to 2200 mm in receiving FM radio broadcast waves.

The above structure is effective for overcoming the above noted problems inherent in the prior art antenna.

It is accordingly an object of the present invention to provide a novel and improved glass antenna system which is enabled to attain such a high gain that exceeds beyond that of a whip antenna in receiving FM radio broadcast waves and AM radio broadcast waves, by a combination of two vertical conductive strips and one horizontal conductive strip.

It is a further object of the present invention to provide a novel and improved glass antenna system of the foregoing character which can be used for reception of TV broadcast waves.

DETAILED DESCRIPTION OF THE PREFERRED EMBODIMENTS

Figure 1:
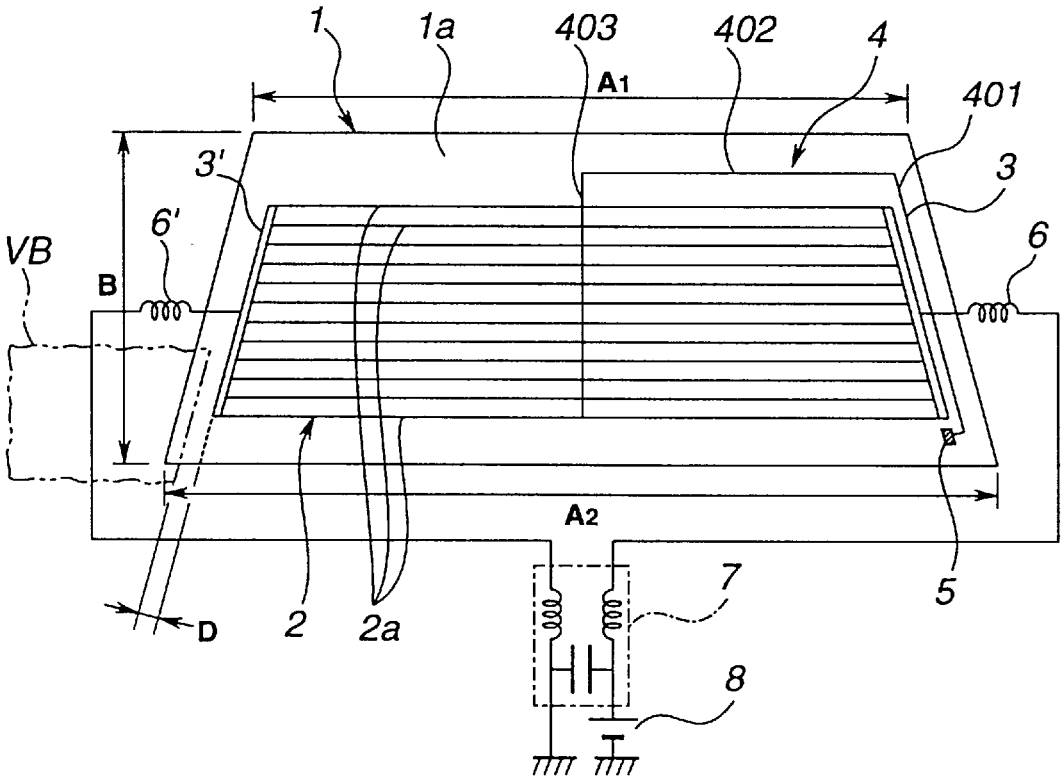
FIG. 1 is a plan view of an automobile rear window glass provided with a glass antenna according to an embodiment of the present invention.

Referring first to FIG. 1, a glass antenna system according to an embodiment of the present invention will be described. In FIG. 1, a window glass for use as an automobile rear window glass is indicated by 1. The window glass 1 is 1100 mm in the length A1 of the upper edge, 1350 mm in the length A2 of the lower edge and 520 mm in the length B perpendicular to the upper and lower edges. The window glass 1 has on the inboard surface thereof a defogging electric heater element 2 consisting of a plurality of heating strips 2*a* and a pair of bus bars 3 and 3', in a way as to leave a space 1*a* around the heater element 2. The heating strips 2*a* extend horizontally and connect between the bus bars 3 and 3'. The window glass 1 further has on the inboard surface thereof an antenna 4. In this embodiment, a smallest value of the distance D between the bus bar 3 or 3' and a metallic vehicle body portion VB such as a panel flange defining a rear window opening is set to 25 mm, and the antenna 4 is shown by way of example as being tuned to FM radio broadcast waves in the band of 76–90 MHz in Japan. The antenna 4 consists of a feed point 5, a first vertical conductive strip 401, a horizontal conductive strip 402 and a second vertical conductive strip 403. The feed point 5 is disposed in a widthwise marginal area of the space 1*a* under one bus bar 3, i.e., under the heater element 2. The first vertical conductive strip 401 is 350 mm long and disposed in an area of the space 1*a* between the bus bar 3 and a lateral edge of the window glass 1. The first vertical conductive strip 401 has a lower end connected to the feed point 5 and is 5 mm distant from the bus bar 3. The horizontal strip 402 is 460 mm long and connected at one of opposite ends thereof to an upper end of the first vertical conductive strip 401. The horizontal conductive strip 402 is disposed in an area of the space 1*a* between heater element 2 and the upper edge of the window glass 1 and 50 mm distant from the uppermost one of the heating strips 2*a*. The second vertical conductive strip 403 is 330 mm long, connected at an upper end thereof to the other of the opposite ends of the horizontal conductive strip 402 and extends downwardly therefrom in a way as to intersect at right angles while being electrically connected to the heating strips 2*a*. The second vertical conductive strip 403 has a lower end connected to the lowermost one of the heating strips 2*a*. The heater element 2 and the antenna 4 are formed by printing a conductive paste onto the window glass 1 and baking, after drying, the printed paste.

The total length of the antenna 4 is 1140 mm and is therefore substantially equal to the resonance length in the FM radio broadcast band of 76–90 MHz in Japan.

The above described window glass 1 is installed in an automobile rear window, and then the bus bars 3 and 3' are connected to a DC power circuit, i.e., one 3 is connected through a high frequency coil 6 and a choke coil 7 to a DC power source 8 and the other 3' is grounded through a high frequency coil 6' and a choke coil 7.

Under the condition where the bus bars 3 and 3' are connected to the power source 8, the gains of the glass antenna system of this embodiment in receiving a FM radio broadcast wave in the band of 76–90 MHz in Japan and a FM radio broadcast wave in the band of 88–108 MHz in Europe and America, etc., with respect to horizontally polarized waves, were measured and compared with that of a standard dipole antenna. That is, for any frequency the gain of the dipole antenna was taken as the basis, 0 dB, and the gain of the glass antenna system of this embodiment was marked on this basis (hereinafter, the difference in gain is referred to as "dipole ratio"). The result was such that the average gains of the glass antenna system in receiving the above band waves were respectively −11.5 dB and −14.9 dB. In contrast to this, both the corresponding average gains of a comparable whip antenna were about −15 dB. Considering that the glass antenna system of this embodiment can attain a gain that is far higher than that of the whip antenna, the glass antenna system of this embodiment can be judged as a considerably good antenna for reception of FM radio broadcast waves.

Figure 18:
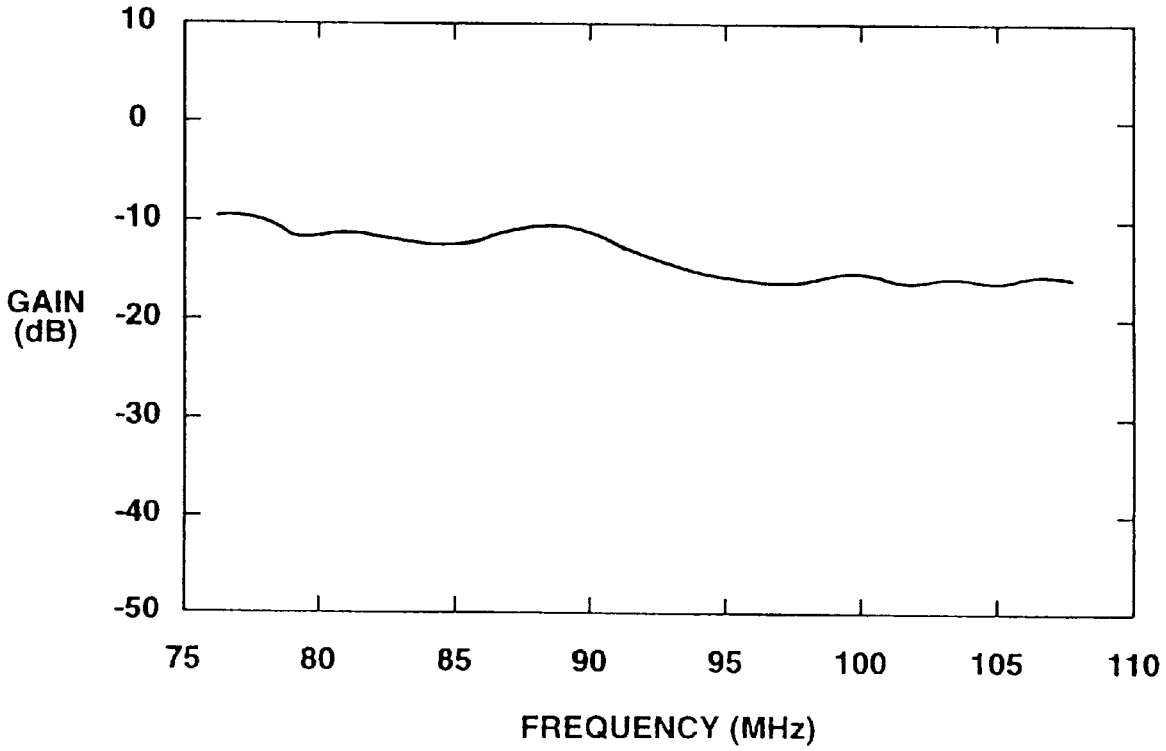
FIG. 18 is a graph showing a frequency characteristic of the glass antenna system of FIG. 1, i.e., how the reception gain of the glass antenna system of FIG. 1 in receiving FM radio band waves varies with frequency.

The frequency characteristic of the glass antenna system of this embodiment, which is representative of a reception gain for every frequency, is shown in the graph of FIG. 18. From this graph, it will be seen that the glass antenna system of this embodiment can attain a stably high gain for any frequency band.

Figure 24:
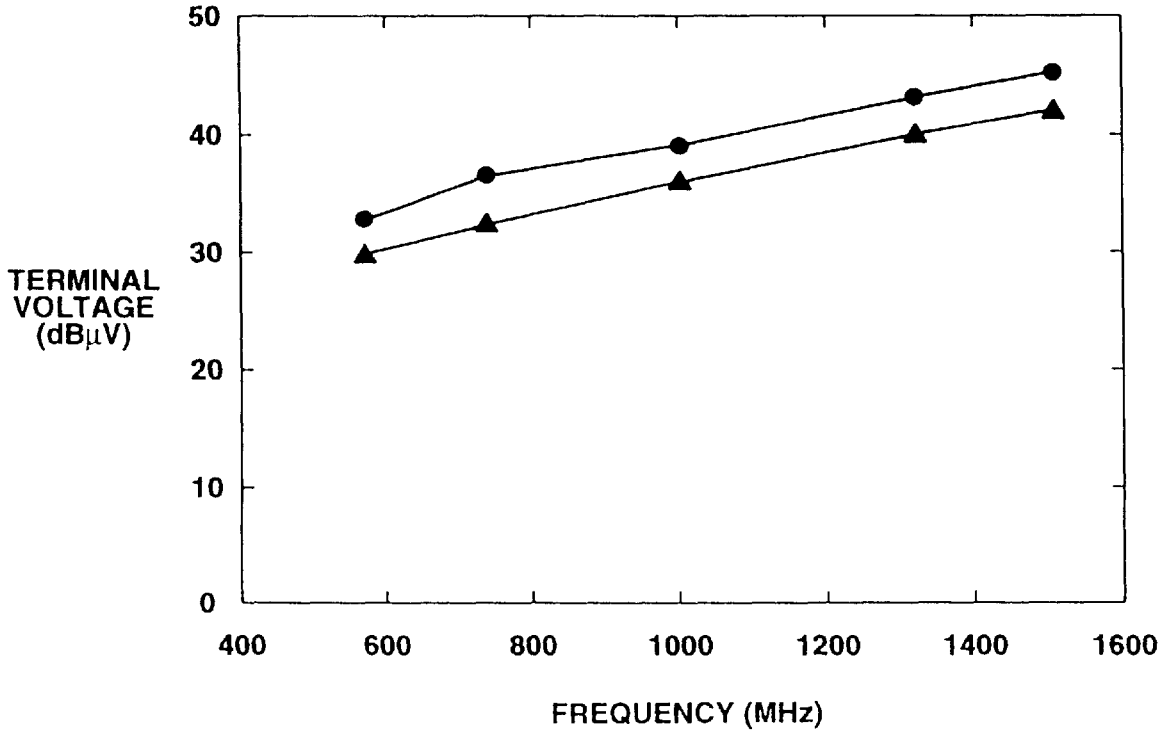
FIG. 24 is a graph showing how terminal voltages of the glass antenna system of FIG. 1 and a whip antenna in receiving AM radio band waves vary with frequency, wherein ● indicates the characteristic of the glass antenna system of FIG. 1 and ▲ indicates the characteristic of a whip antenna.

The terminal voltage of the glass antenna system of this embodiment in receiving an AM radio broadcast wave in the band of 520–1620 KHz was measured to represent the receiving ability or effectiveness thereof and shown by ● in the graph of FIG. 24 wherein the receiving ability or effectiveness of a whip antenna is indicated by ▲. From this graph, it will be seen that the effectiveness of the glass antenna system of this embodiment is higher than that of the whip antenna by 3 dB for any frequency band, so the glass antenna system of this embodiment is a considerably good antenna for AM radio broadcast waves.

In the meantime, it was confirmed that for TV broadcast waves the glass antenna system of this embodiment can attain a nearly equal gain to that of a glass antenna usually used for reception of TV broadcast waves.

Figure 25:
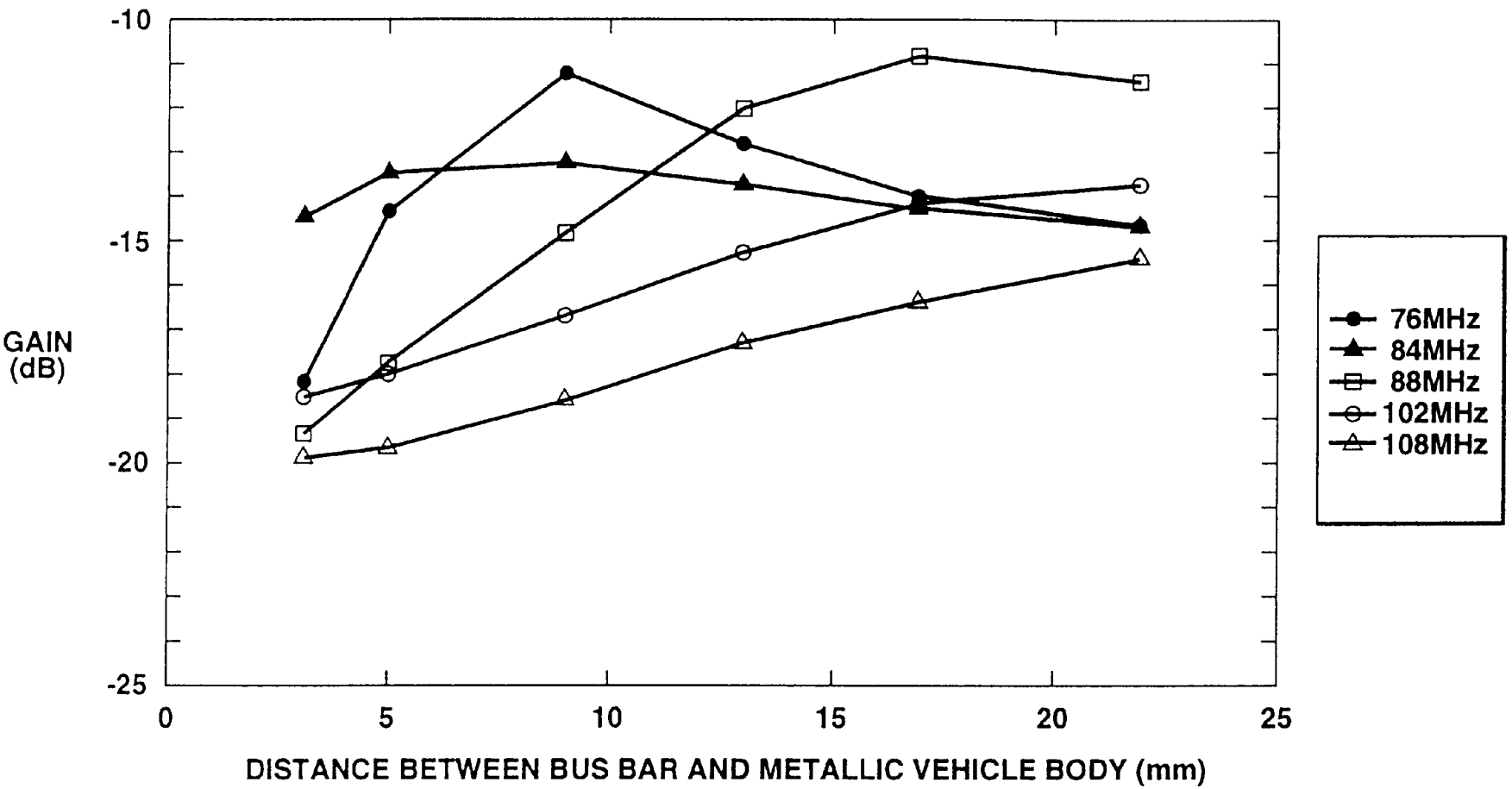
FIG. 25 is a graph showing how the reception gain of the glass antenna system of FIG. 1 in receiving FM radio broadcast waves varies with the distance between a bus bar and a metallic vehicle body.

The graph of FIG. 25 shows how the reception gain of the glass antenna system of FIG. 1 in receiving FM radio broadcast waves varies with the distance D between the bus bar 3 or 3' and the metallic body portion VB such as a panel flange. From this graph, it will be seen that the average gain of the glass antenna system in receiving FM radio broadcast waves generally becomes higher as the distance D becomes larger.

Figure 2:
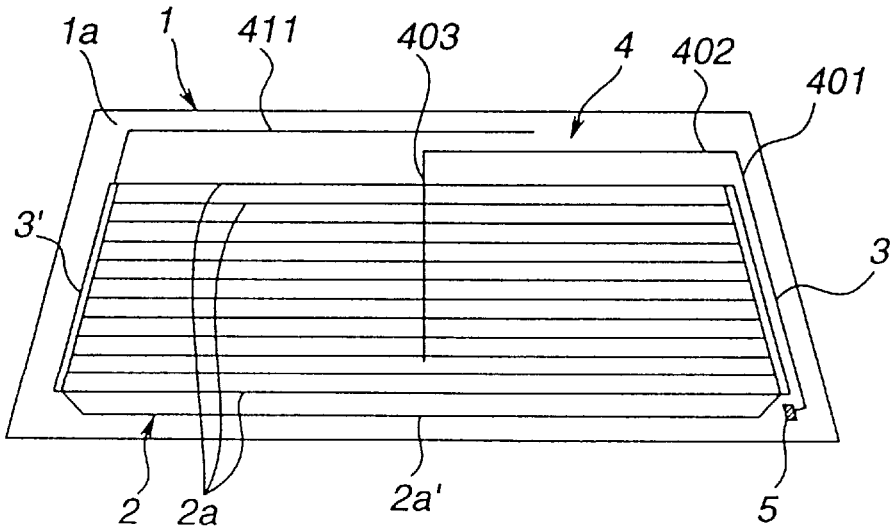
FIGS. 2 to 17 are views similar to FIG. 1 but show further embodiments of the present invention.

Referring to FIG. 2, a glass antenna system according to another embodiment will be described. In the meantime, throughout the drawings, similar parts and portions are designated by similar reference characters and repeated description thereto will not be made.

In this embodiment of FIG. 2, the smallest value of the distance D is set to 15 mm, and the glass antenna system includes an auxiliary element 411 connected to an upper end of the bus bar 3' and is tuned to FM radio broadcast waves in the band of 76–90 MHz.

The antenna 4 in this embodiment includes a first vertical conductive strip 401 which is 350 mm long and 5 mm distant from the bus bar 3, a horizontal conductive strip 402 which is 460 mm long and a second vertical conductive strip 403 which is 300 mm long. The auxiliary element 411 is disposed in an area of the space 1*a* above the heater element 2 and consists of a vertical conductive strip of the length of 70 mm and connected at a lower end thereof to the bus bar 3' so as to extend in the direction of extension of the bus bar 3', and a horizontal conductive strip which is 970 mm long and connected at one end thereof to an upper end of the vertical conductive strip. The heater element 2 further includes a heating strip 2*a*' connected to the lower ends of the bus bars 3 and 3' for preventing freezing of a wiper (not shown). Except for the above, this embodiment is substantially similar to the embodiment of FIG. 1. In the meantime, the DC power circuit is omitted in FIG. 2 for brevity.

The gains of the glass antenna system of this embodiment in receiving FM radio broadcast waves in the band of 76–90 MHz band and FM radio broadcast waves in the band of 88–108 MHz, with respect to horizontally polarized waves, were measured and compared with a standard dipole antenna for indication thereof by using the above described dipole ratio. The result was such that the average gains of the glass antenna system of this embodiment in receiving the above band waves were respectively −12.8 dB and −17.8 dB and thus far higher than that of a whip antenna in receiving a wave in the band of 76–90 MHz. The gain of the glass antenna system of this embodiment is a little lower as compared to that of the glass antenna system of FIG. 1. This is due to the fact that the smallest value of the distance D between the bus bars 3 and 3' and the vehicle body portion VB is set smaller. Further, it was recognized that the gain of the glass antenna system of this embodiment in receiving an AM radio broadcast wave in the band of 520–1620 KHz was nearly equal to that of the whip antenna.

Figure 3:
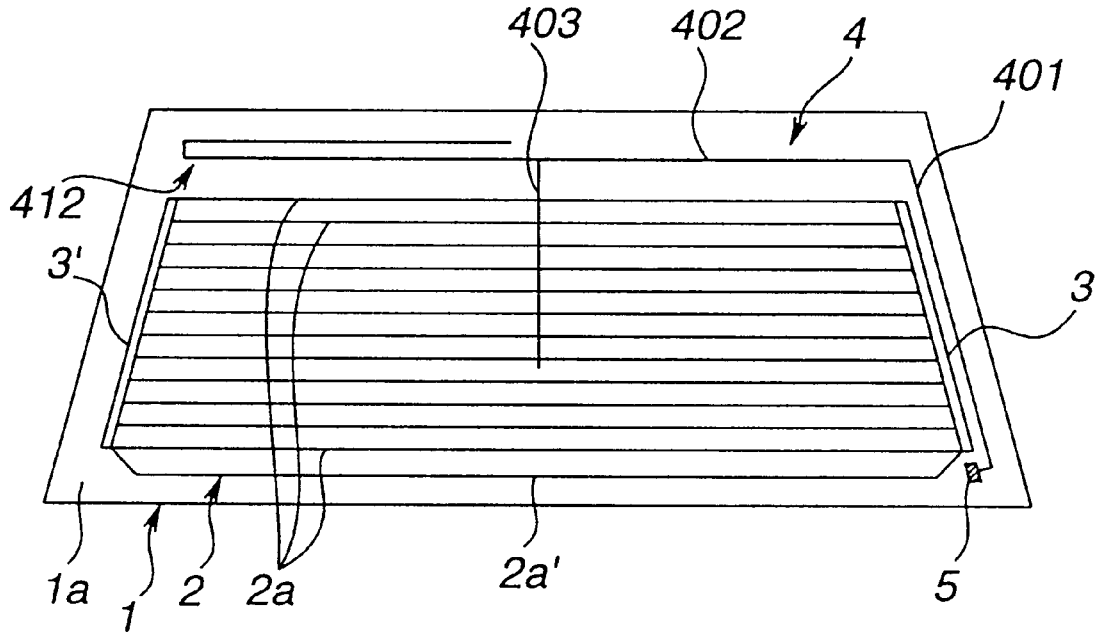

Referring to FIG. 3, a glass antenna system according to a further embodiment will be described. In this embodiment of FIG. 3, the smallest value of the distance D is set to 15 mm, and the glass antenna system includes an auxiliary element 412 connected to a horizontal conductive strip 402 of an antenna 4 and is tuned to FM radio broadcast waves in the band of 88–108 MHz.

The antenna 4 in this embodiment includes a first vertical conductive strip 401 which is 350 mm long and 5 mm distant from the bus bar 3, the above described horizontal conductive strip 402 which is 460 mm long and a second vertical conductive strip 403 which is 250 mm long. The auxiliary element 412 is disposed in an area of the space 1*a* above the heater element 2 and consists of a pair of parallel horizontal conductive strips and a vertical conductive strip connecting between one ends of the horizontal conductive strip. Lower one of the horizontal conductive strips is 460 mm long and connected at the other end thereof to the horizontal conductive strip 402 in a way as to extend in the direction of extension of same, and upper one of the horizontal conductive strips is 400 mm long, and the vertical conductive strip is 20 mm long. The heater element 2 further includes a heating strip 2*a*' connected to the lower ends of the bus bars 3 and 3' for preventing freezing of a wiper (not shown). Except for the above, this embodiment is substantially similar to the embodiment of FIG. 1. In the meantime, the DC power circuit is omitted in FIG. 3 for brevity.

The gains of the glass antenna system of this embodiment in receiving a FM radio broadcast wave in the band of 76–90 MHz band and a FM radio broadcast wave in the band of 88–108 MHz, with respect to horizontally polarized waves, were measured and compared with a standard dipole antenna for indication thereof by using the above described dipole ratio. The result was such that the average gains of the glass antenna system in receiving the above band waves were respectively −15.1 dB and −13.4 dB and thus far higher than that of the whip antenna in receiving a wave in the band of 88–108 MHz and nearly equal to it in receiving a wave in the band of 76–90 MHz.

Figure 19:
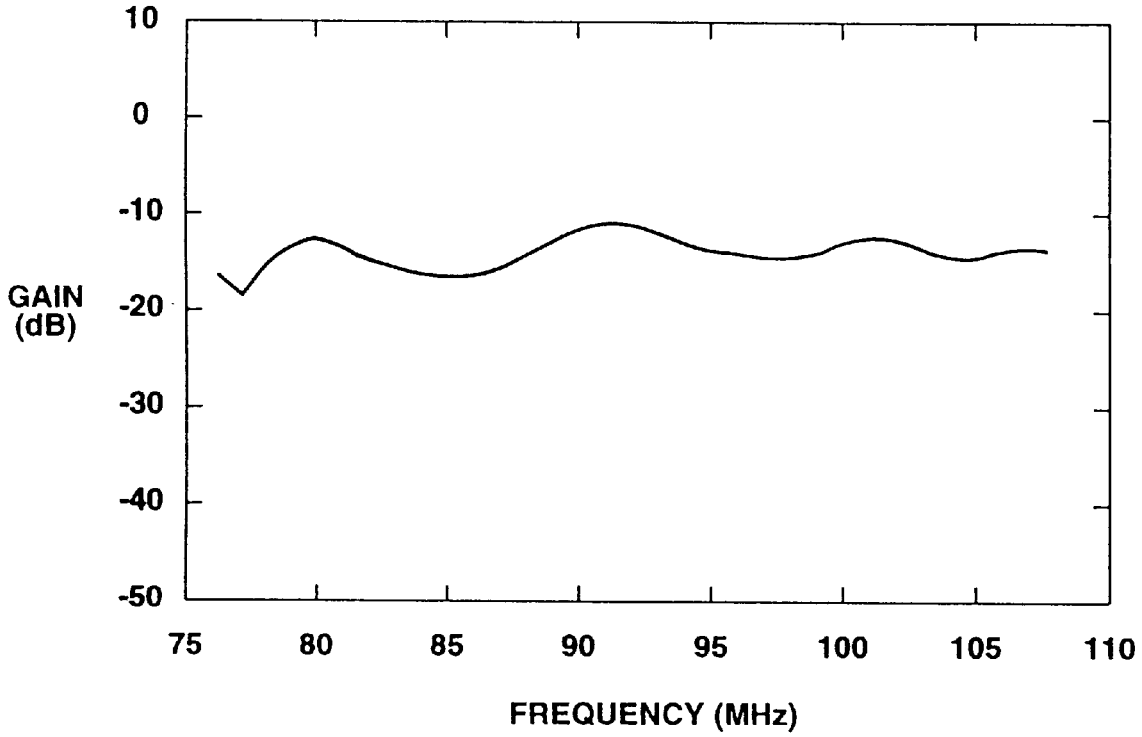
FIGS. 19 to 23 are similar views to FIG. 18 but for the embodiments of FIGS. 3, 8, 10, 14 and 16, respectively.

The frequency characteristic of the glass antenna system of this embodiment, which is representative of a reception gain for every frequency, is shown in the graph of FIG. 19. From this graph, it will be seen that the glass antenna system of this embodiment can attain a stably high gain for any frequency band.

The gain of the glass antenna system of this embodiment is a little lower as compared to that of the embodiment of FIG. 1. Similarly to the embodiment of FIG. 2, this is due to the fact that the smallest value of the distance D between the bus bars 3 and 3' and the vehicle body portion VB is set a little smaller.

Figure 4:
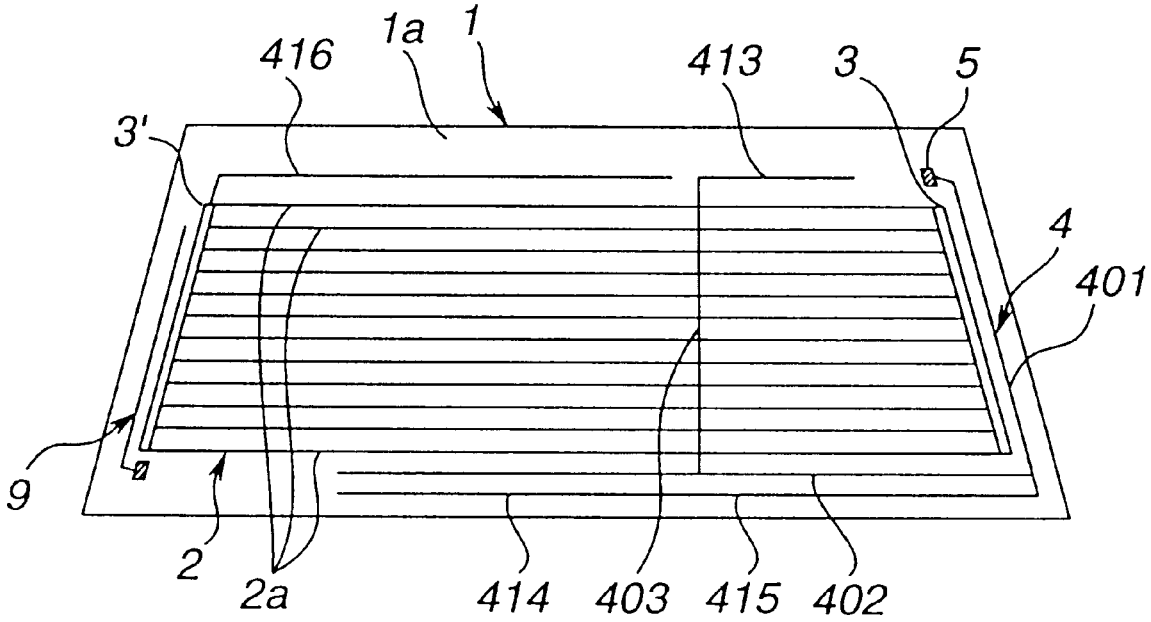

Referring to FIG. 4, a glass antenna system according to a fourth embodiment will be described.

In this embodiment, the dimensions of the window glass 1 is 950 mm in the length A1 (refer to FIG. 1) of the upper edge, 1120 mm in the length A2 of the lower edge and 540 mm in the length B perpendicular to the upper and lower edges, the smallest value of the distance D is set to 15 mm, and the glass antenna system includes auxiliary elements 413, 414, 415 and 416 and is tuned to FM radio broadcast waves of 88–108 MHz.

The antenna 4 in this embodiment includes a first vertical conductive strip 401 which is 350 mm long and 2 mm distant from the bus bar 3, a horizontal conductive strip 402 which is 220 mm long and disposed in an area of the space 1*a* under the heater element 2, and a second vertical conductive strip 403 which is 370 mm long and extends upwardly from one end of the horizontal conductive strip 402. The auxiliary element 413 is disposed in an area of the space 1*a* above the heater element 2 and consists of a horizontal conductive strip which is 150 mm long and connected to an upper end of the second vertical conductive strip 403. The auxiliary element 414 is disposed in the area of the space 1*a* under the heater element 2 and consists of a horizontal conductive strip which is 550 mm long and connected to the junction between the horizontal conductive strip 402 and the second vertical conductive strip 403 so as to extend in the direction of extension of the horizontal conductive strip 402. The auxiliary element 415 is disposed in an area of the space 1*a* under the horizontal conductive strip 402 and consists of a horizontal conductive strip which is 770 mm long and 20 mm distant from the horizontal conductive strip 402, and is connected at one end thereof to the junction between the first vertical conductive strip 401 and the horizontal conductive strip 402 by way of a short vertical conductive strip. The auxiliary element 416 is disposed in an area of the space 1*a* above the heater element 2 and consists of a vertical conductive strip which is 40 mm long and connected to the upper end of the bus bar 3' so as to extend in the direction of extension of same and a horizontal conductive strip which is 600 mm long and connected at one end thereof to the upper end of the vertical conductive strip.

The glass antenna system of this embodiment is further provided with an antenna 9 which serves as a subsidiary antenna. The antenna 9 is disposed in an area of the space 1*a* between the bus bar 3' and a lateral edge of the window glass 1 and consists of a feed point disposed in a widthwise marginal area of the space 1*a* under the heater element 2 and a vertical conductive strip extending along the bus bar 3'.

Except for the above, this embodiment is substantially similar to the first embodiment of FIG. 1. In the meantime, the DC power circuit is omitted in FIG. 4 for brevity.

The gains of the glass antenna system of this embodiment in receiving a FM radio broadcast wave in the band of 76–90 MHz band and a FM radio broadcast wave in the band of 88–108 MHz, with respect to horizontally polarized waves, were measured and compared with a standard dipole antenna for indication thereof by using the above described dipole ratio. The result was such that the average gains of the glass antenna system in receiving the above band waves were respectively −17.1 dB and −13.3 dB and thus far higher than that of the whip antenna in receiving a wave in the band of 88–108 MHz to which this glass antenna system is tuned.

The gain of the glass antenna system of this embodiment is a little lower as compared to that of the embodiment of FIG. 1. Similarly to the embodiments of FIGS. 2 and 3, this is due to the fact that the smallest value of the distance D between the bus bars 3 and 3' and the vehicle body portion VB such as a panel flange is set a little smaller.

It is a matter of course that a desired or satisfactory gain in reception of FM radio broadcast waves can be attained by the use of the antenna 4 alone, but it is more preferable to additionally use the antenna 9 to carry out diversity reception.

Figure 5:
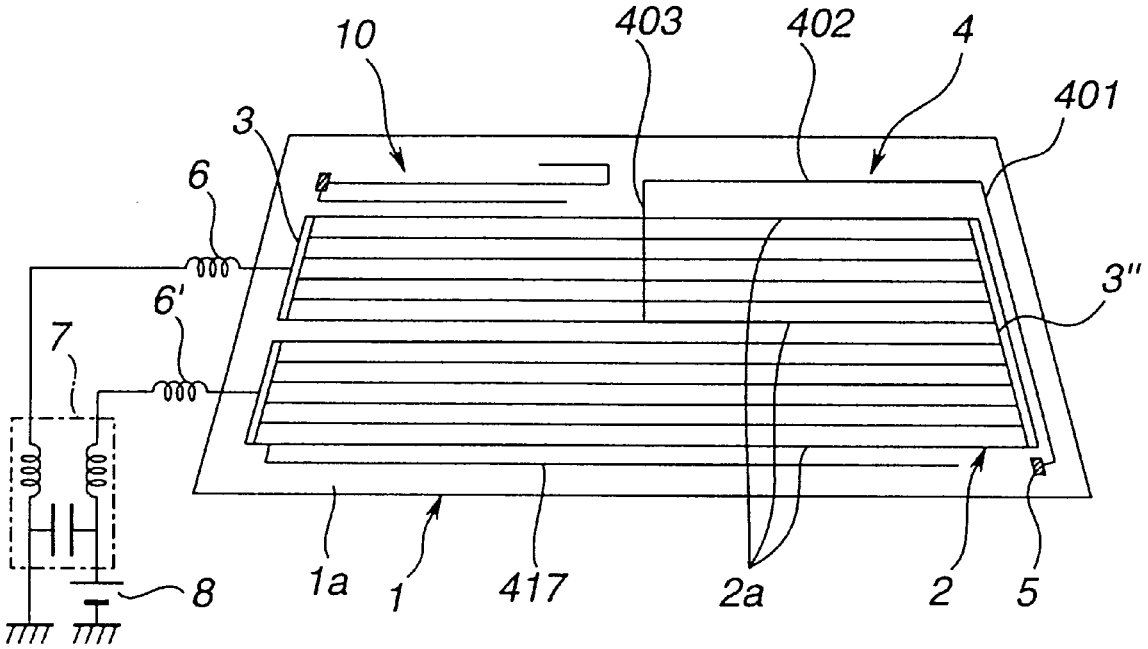

Referring to FIG. 5, a glass antenna system according to a further embodiment will be described.

In this embodiment, the dimensions of the window glass 1 is 1150 mm in the length A1 (refer to FIG. 1) of the upper edge, 1350 mm in the length A2 of the lower edge and 780 mm in the length B perpendicular to the upper and lower edges, the heating strips 2*a* are divided into two groups which are connected at one ends to the bus bars 3 and 3', respectively and at the other ends to the common bus bar 3", the smallest value of the distance D is set to 12 mm, and the glass antenna system includes an auxiliary element 417 connected to the heater element 2 and is tuned to FM radio broadcast waves in the band of 76–90 MHz.

The antenna 4 in this embodiment includes a first vertical conductive strip 401 which is 450 mm long and 7 mm distant from the bus bar 3", a horizontal conductive strip 402 which is 570 mm long, and a second vertical conductive strip 403 which is 230 mm long. The auxiliary element 417 is disposed in an area of the space 1*a* under the heater element 2 and consists of a vertical conductive strip which is 30 mm long and connected to the lowermost one of the heating strips 2*a* and a horizontal conductive strip which is 940 mm long and connected at one end thereof to a lower end of the vertical conductive strip.

The glass antenna system of this embodiment is further provided with an antenna 10 which serves as a subsidiary antenna for reception of a FM radio broadcast wave. The antenna 10 is disposed in an area of the space 1*a* above the heater element 2. The bus bars 3 and 3' are connected to a DC power circuit, i.e., one 3' is connected through high frequency coil 6' and choke coil 7 to a DC power source 8 and the other 3 is grounded through a high frequency coil 6 and choke coil 7.

Except for the above, this embodiment is substantially similar to the embodiment of FIG. 1.

The gains of the glass antenna system of this embodiment in receiving a FM radio broadcast band wave in the band of 76–90 MHz and a FM radio broadcast band wave in the band of 88–108 MHz, with respect to horizontally polarized waves, were measured and compared with a standard dipole antenna for indication thereof by using the above described dipole ratio. The result was such that the average gains of the glass antenna system in receiving the above band waves were respectively −12.4 dB and −14.4 dB and thus far higher than that of the dipole antenna in receiving a wave in the band of 76–90 MHz and also higher than that of the dipole antenna in receiving a wave in the FM broadcast band of 88–108 MHz, so this embodiment can attain substantially the same effect with the embodiment of FIG. 1. That is, the same effect results due to the fact that the dimensions of the window glass 1 is larger, not withstanding the smallest value of the distant D is smaller than that of the embodiment of FIG. 1.

Further, it was recognized that the gain of the glass antenna system of this embodiment in receiving an AM radio broadcast wave was substantially equal to that of the embodiment of FIG. 1.

It is a matter of course that a desired or satisfactory gain in reception of FM radio broadcast waves can be attained by the use of the antenna 4 alone, but it is more preferable to additionally use the antenna 10 to carry out diversity reception.

Figure 6:
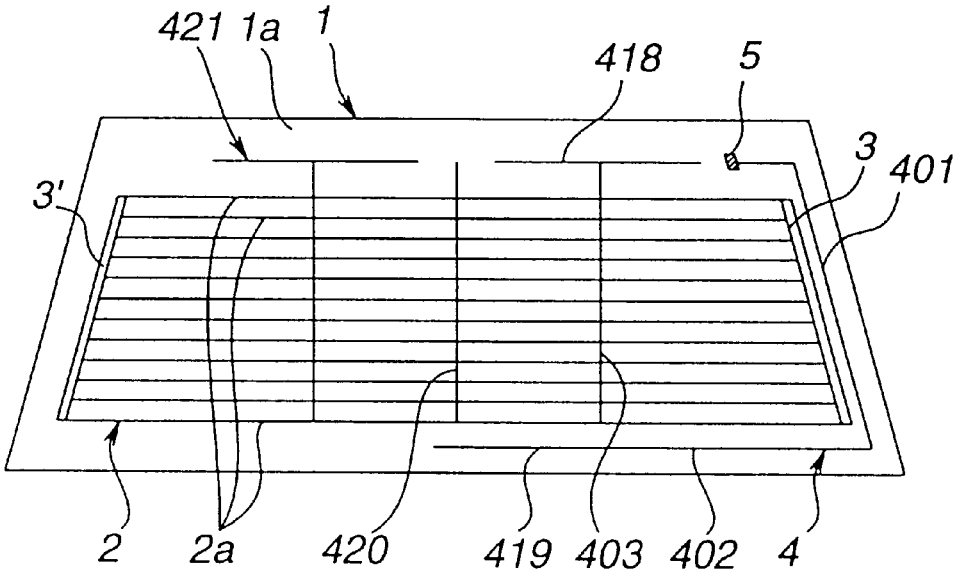

Referring to FIG. 6, a glass antenna system according to a further embodiment will be described.

In this embodiment, the smallest value of the distance D is set to 15 mm, and the glass antenna system is tuned to FM radio broadcast waves in the band of 88–108 MHz.

The antenna 4 in this embodiment includes a feed point 5 disposed in a widthwise marginal area of the space 1*a* above the heater element 2, a first vertical conductive strip 401 connected at an upper end thereof to the feed point 5, a horizontal conductive strip 402 disposed in an area of the space 1*a* under the heater element 2 and connected at one of opposite ends thereof to a lower end of the first vertical conductive strip 401, and a second vertical conductive strip 403 connected at a lower end thereof to the other of the opposite ends of the horizontal conductive strip 402 and extending upwardly therefrom in a way as to intersect at right angles while being electrically connected to the heating strips 2*a*.

The glass antenna system is further provided with auxiliary elements 418, 419, 420 and 421. The auxiliary element 418 is disposed in an area of the space above the heater element 2 and consists of a horizontal conductive strip connected at a middle portion thereof to the upper end of the second vertical conductive strip 403. The auxiliary element 419 is disposed in an area of the space 1*a* under the heater element 2 and consists of a horizontal conductive strip connected at one end thereof to the junction between the horizontal conductive strip 402 and the second vertical conductive strip 403 in a way as to extend in the direction of extension of the horizontal conductive strip 402. The auxiliary element 420 consists of a vertical conductive strip extending between the uppermost one and lowermost one of the heating strips 2*a* in a way as to intersect at right angles while being electrically connected to the nearly the middle portions of the heating strips. The auxiliary element 421 consists of a horizontal conductive strip disposed in an area of the space la above the heater element 2 and a vertical conductive strip connected at an upper end thereof to a nearly central portion of the horizontal conductive strip and extending downwardly in a way as to intersect at right angles while being electrically connected to the heating strips 2*a* so as to have a lower end connected to the lowermost one of the heating strips 2*a*. The vertical conductive strip of the auxiliary element 421 and the second vertical conductive strip 403 of the antenna 4 are disposed on the opposite sides of the auxiliary element 420.

The gains of the glass antenna system of this embodiment in receiving the above described FM radio waves in the band of 88–108 MHz were measured and compared with a standard dipole antenna for indication thereof by using the above described dipole ratio. The result was such that the average gain of the glass antenna system of this embodiment was 13.6 dB and far higher than that of the whip antenna.

Except for the above, this embodiment is substantially similar to the embodiment of FIG. 1 and can produce substantially the same effect.

Figure 7:
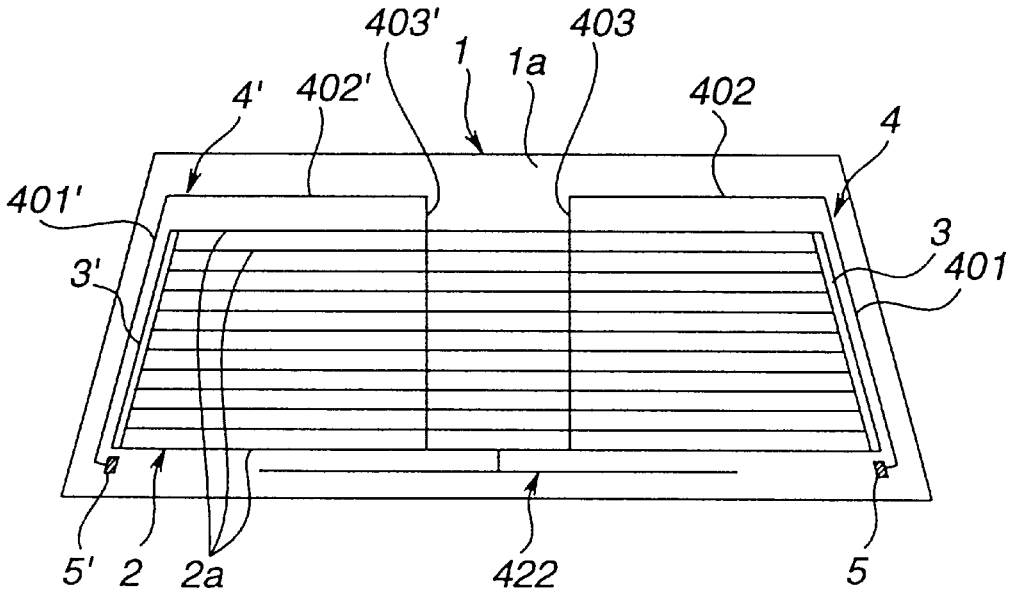

Referring to FIG. 7, a glass antenna system according to a further embodiment will be described.

The antenna 4 in this embodiment includes a feed point 5 disposed in a widthwise marginal area of the space 1*a* under the heater element 2, a first vertical conductive strip 401 connected at a lower end thereof to the feed point 5, a horizontal conductive strip 402 disposed in an area of the space 1*a* above the heater element 2 and connected at one of opposite ends thereof to an upper end of the first vertical conductive strip 401, and a second vertical conductive strip 403 connected at an upper end thereof to the other of the opposite ends of the horizontal conductive strip 402 and extending downwardly therefrom in a way as to intersect at right angles while being electrically connected to the heating strips 2*a* so as to have a lower end connected to the lowermost one of the heating strips 2*a*.

The glass antenna system is further provided with an antenna 4'. The antennas 4 and 4' have symmetrical patterns or shapes with respect to a vertical axis extending through a widthwise central portion of the window glass 1. That is, the glass antenna 4' consists of a feed point 5' disposed in a widthwise marginal area of the space 1*a* under the heater element 2 and a first vertical conductive strip 401' disposed between the bus bar 3' and a lateral edge of the window glass 2 and connected at a lower end thereof to the feed point 5', a horizontal conductive strip 402' disposed in an area of the space 1*a* above the heater element 2 and connected at one of opposite ends thereof to an upper end of the first vertical conductive strip 401' and a second vertical conductive strip 403' connected at an upper end thereof to the other of the opposite ends of the horizontal conductive strip 402'.

The glass antenna system is further provided with an auxiliary element 422 disposed in an area of the space 1*a* under the heater element 2 and consists of a vertical conductive strip connected at an upper end thereof to a middle portion of the lowest one of the heating strips 2*a* and a horizontal conductive strip connected at a middle portion thereof to a lower end of the vertical conductive strip.

Except for the above, this embodiment is substantially similar to the embodiment of FIG. 1 and can produce substantially the same effect. In the meantime, it is a matter of course that a desired or satisfactory gain in reception of FM radio broadcast waves can be attained by the use of the antenna 4 alone, but it is more preferable to additionally use the antenna 4' to carry out diversity reception.

Figure 8:
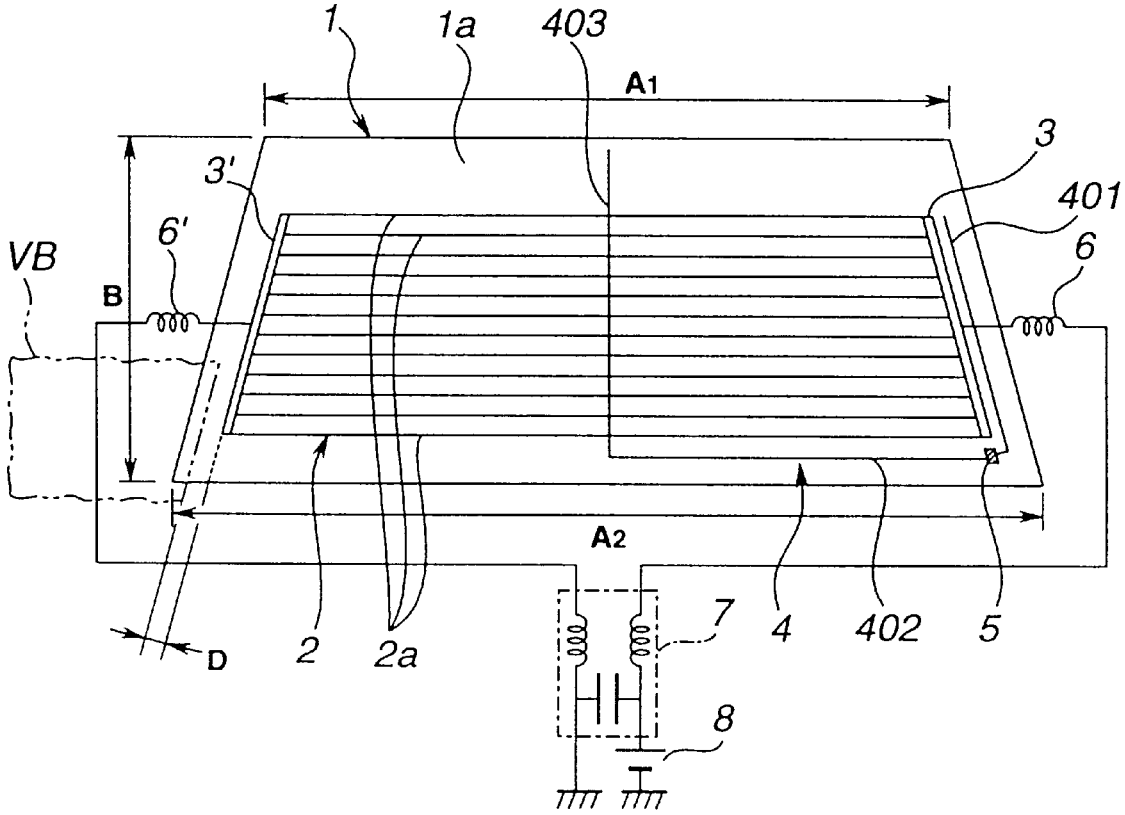

Referring to FIG. 8, a glass antenna system according to a further embodiment will be described.

In this embodiment, the window glass 1 is 1100 mm in the length A1 of the upper edge, 1350 mm in the length A2 of the lower edge and 520 mm in the length B perpendicular to the upper and lower edges. The smallest value of the distance D is set to 20 mm, and the glass antenna system is tuned to a FM radio broadcast wave in the band of 88–108 MHz.

The antenna 4 in this embodiment includes a first vertical conductive strip 401 which is 330 mm long and 5 mm distant from the bus bar 3, a horizontal conductive strip 402 which is 580 mm long, disposed in an area of the space 1*a* under the heater element 2 so as to be 30 mm distant from the lowermost one of the heating strips 2*a* and connected at one of opposite ends thereof to the feed point 5, and a second vertical conductive strip 403 which is 400 mm long and connected at a lower end thereof to the other of the opposite ends of the horizontal conductive strip 402 and extending upwardly therefrom in a way as to intersect at right angles while being electrically connected to the heating strips 2*a*. The bus bars 3 and 3' are connected to a DC power source by way of high frequency coils 6 and 6' and a choke coil 7.

The total length of the horizontal conductive strip 402 and the second vertical conductive strip 403 is 980 mm and is therefore substantially equal to the resonance length in the FM radio broadcast band of 88–108 MHz in North America, Europe, etc.

Except for the above, this embodiment is substantially similar to the embodiment of FIG. 1.

The gains of the glass antenna system of this embodiment in receiving a FM radio broadcast band wave in the band of 76–90 MHz and a FM radio broadcast wave in the band of 88–108 MHz, with respect to horizontally polarized waves, were measured and compared with a standard dipole antenna for indication thereof by using the above described dipole ratio. The result was such that the average gains of the glass antenna system of this embodiment in receiving the above described band waves were respectively −16.8 dB and −13.3 dB. In contrast to this, both of the corresponding average gains of a comparable whip antenna were about −15 dB. Considering that the gain of the glass antenna system of this embodiment is far higher in receiving a wave in the band of 88–108 MHz to which the glass antenna system is tuned, the glass antenna system of this embodiment can be judged as a considerably good antenna for reception of FM radio broadcast band waves.

Figure 20:
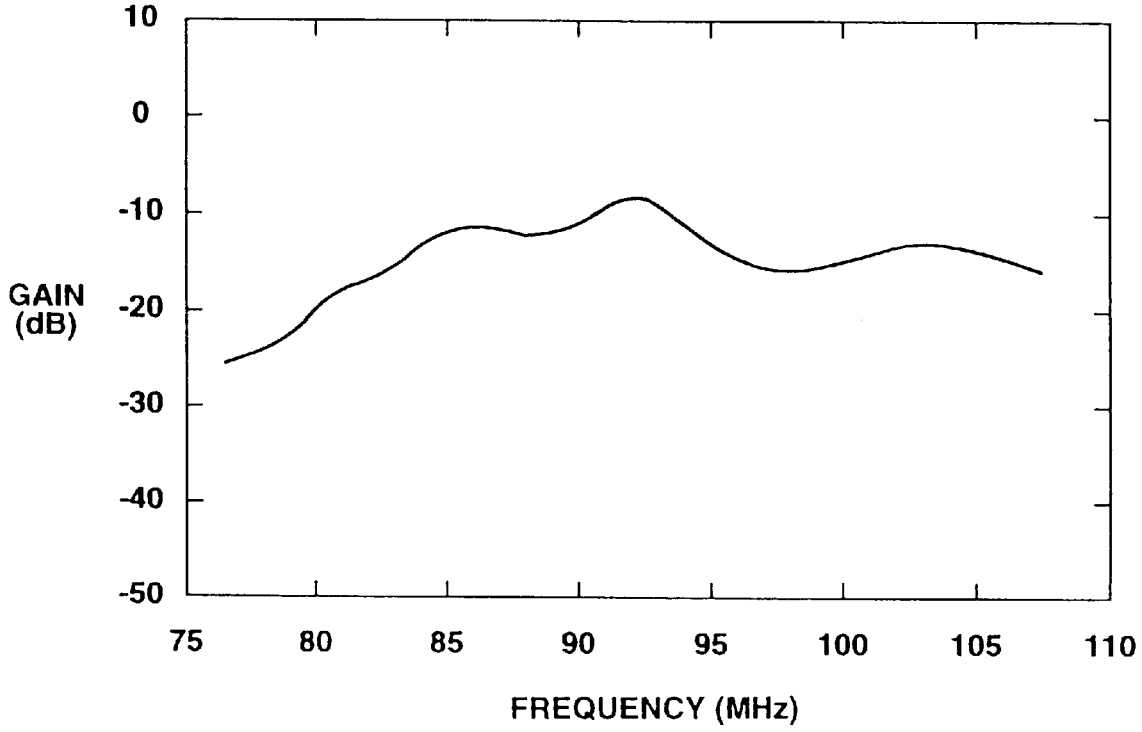

The frequency characteristic of the glass antenna system of this embodiment, which is representative of a reception gain for every frequency, is shown in the graph of FIG. 20. From this graph, it will be seen that the glass antenna system of this embodiment can attain a high gain in receiving a wave in the band of 88–108 MHz.

Further, it was recognized that the gain of the glass antenna system of this embodiment in receiving an AM radio broadcast wave in the band of 520–1620 KHz was nearly equal to that of the whip antenna.

Figure 26:
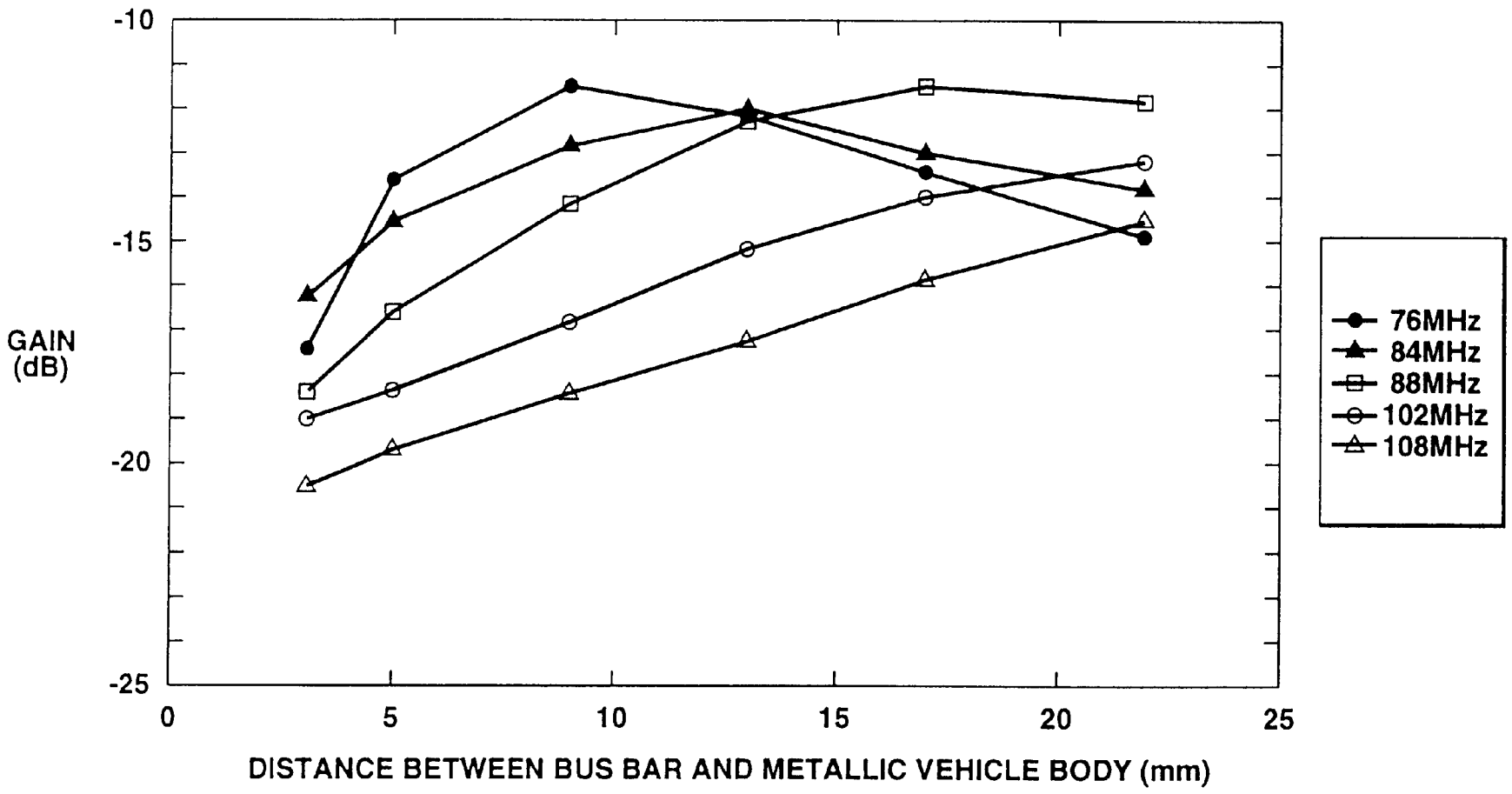
FIGS. 26 and 27 are views similar to FIG. 25 but for the embodiments of FIGS. 8 and 14, respectively.

The graph of FIG. 26 shows how the reception gain of the glass antenna system of FIG. 1 in receiving FM radio broadcast waves varies with the distance D between the bus bar 3 or 3' and the metallic body portion VB such as a panel flange. From this graph, it will be seen that the average gain of the glass antenna system in receiving FM radio broadcast waves generally becomes higher as the distance D becomes larger.

Figure 9:
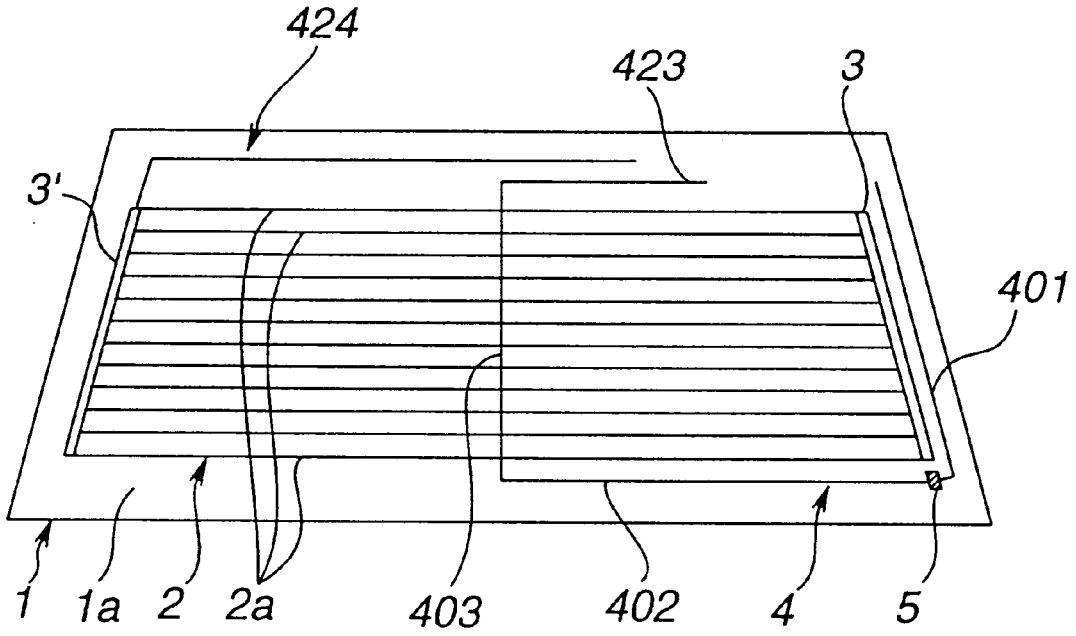

Referring to FIG. 9, a glass antenna system according to a further embodiment will be described.

In this embodiment, the smallest value of the distance D is set to 15 mm, and the glass antenna system includes auxiliary elements 423 and 424 and is tuned to FM radio broadcast waves in the band of 76–90 MHz.

The antenna 4 in this embodiment includes a first vertical conductive strip 401 which is 330 mm long and 5 mm distant from the bus bar 3, a horizontal conductive strip 402 which is 580 mm long and a second vertical conductive strip 403 which is 350 mm long. The auxiliary element 423 is disposed in the area of the space 1*a* above the heater element 2 and consists of a horizontal conductive strip which is 300 mm long and connected at one end to the upper end of the second vertical conductive strip 403. The auxiliary element 424 is disposed in an area of the space 1*a* above the heater element 2 and consists of a vertical conductive strip connected at a lower end thereof to an upper end of the bus bar 3' in a way as to extend in the direction of extension of the bus bar 3' and a horizontal conductive strip which is 870 mm long and connected at one end to the upper end of the vertical conductive strip.

Except for the above, this embodiment is substantially similar to the embodiment of FIG. 8. In the meantime, the DC power circuit is omitted in FIG. 9 for brevity.

The gains of the glass antenna system of this embodiment in receiving a FM radio broadcast wave in the band of 76–90 MHz and a FM radio broadcast wave in the band of 88–108 MHz, with respect to horizontally polarized waves, were measured and compared with a standard dipole antenna for indication thereof by using the above described dipole ratio. The result was such that the average gains of the glass antenna system of this embodiment in receiving the above band waves were respectively −12.7 dB and −16.9 dB and thus far higher than that of the whip antenna in receiving a wave in the band of 76–90 MHz.

Further, it was recognized that the gain of the glass antenna system of this embodiment in receiving an AM radio broadcast wave in the band of 520–1620 KHz was nearly equal to that of the whip antenna.

Figure 10:
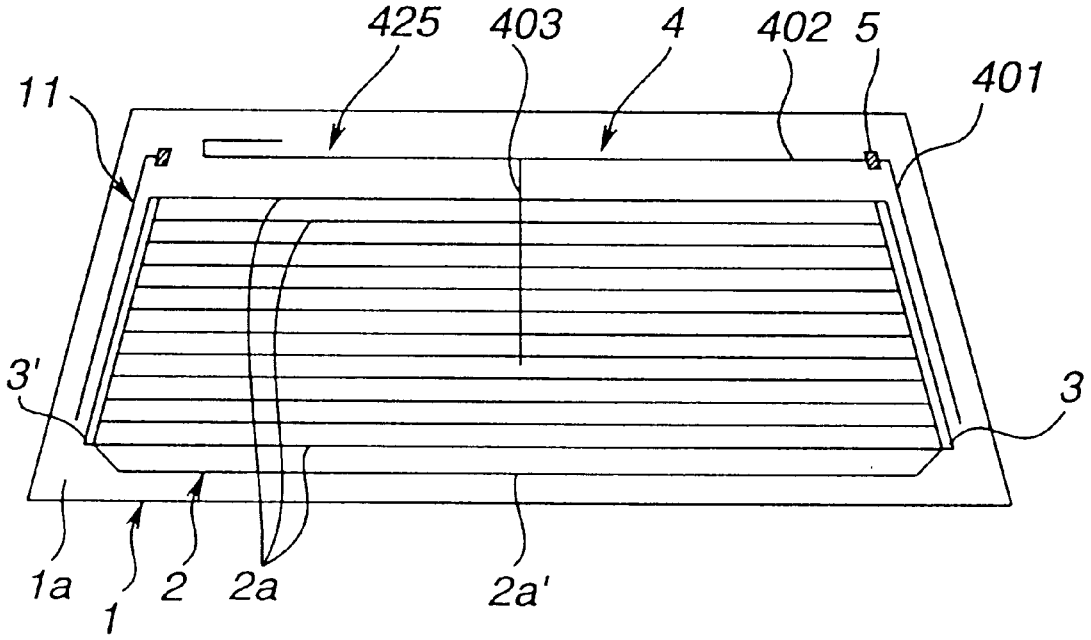

Referring to FIG. 10, a glass antenna system according to a further embodiment will be described.

In this embodiment of FIG. 10, the dimensions of the window glass 1 is 950 mm in the length A1 (refer to FIG. 8) of the upper edge, 1120 mm in the length A2 of the lower edge and 540 mm in the length B perpendicular to the upper and lower edges, the smallest value of the distance D is set to 25 mm, and the glass antenna system includes an auxiliary element 425 and is tuned to FM radio broadcast waves in the band of 76–90 MHz.

The antenna 4 in this embodiment includes a feed point 5 disposed in a widthwise marginal area of the space 1*a* above the heater element 2, a first vertical conductive strip 401 which is 270 mm long, 8 mm distant from the bus bar 3 and connected at an upper end thereof the feed point 5, a horizontal conductive strip 402 which is 420 mm long, disposed in an area of the space 1*a* above the heater element 2 and connected at one of opposite ends thereof to the feed point 5, and a second vertical conductive strip 403 which is 220 mm long and connected at an upper end thereof to the other of the opposite ends of the horizontal conductive strip 402. The auxiliary element 425 is disposed in an area of the space 1*a* above the heater element 2 and consists of a pair of horizontal conductive strips and a vertical conductive strip connecting between one ends of the horizontal conductive strips. Lower one of the horizontal conductive strips is 390 mm long and connected at one end thereof to the junction between the horizontal conductive strip 402 and the second vertical conductive strip 403 in a way as to extend in the direction of extension of the horizontal conductive strip 402, upper one of the horizontal conductive strips is 100 mm long, and the vertical conductive strip is 20 mm long.

The glass antenna system of this embodiment is further provided with an antenna 11 which serves as a subsidiary antenna. The antenna 11 is disposed in an area of the space 1*a* between the bus bar 3' and a lateral edge of the window glass 1.

The heater element 2 further includes a heating strip 2*a'* connected to the lower ends of the bus bars 3 and 3' for preventing freezing of a wiper (not shown). Except for the above, this embodiment is substantially similar to the embodiment of FIG. 8. In the meantime, the DC power circuit is omitted in FIG. 10 for brevity.

The gains of the glass antenna system of this embodiment in receiving a FM radio broadcast band wave in the band of 76–90 MHz and a FM radio broadcast band wave in the band of 88–108 MHz, with respect to horizontally polarized waves, were measured and compared with a standard dipole antenna for indication thereof by using the above described dipole ratio. The result was such that the average gains of the glass antenna system in receiving the above band waves were respectively −12.2 dB and −16.3 dB and thus far higher than that of the whip antenna in receiving a broadcast wave in the band of 76–90 MHz.

Figure 21:
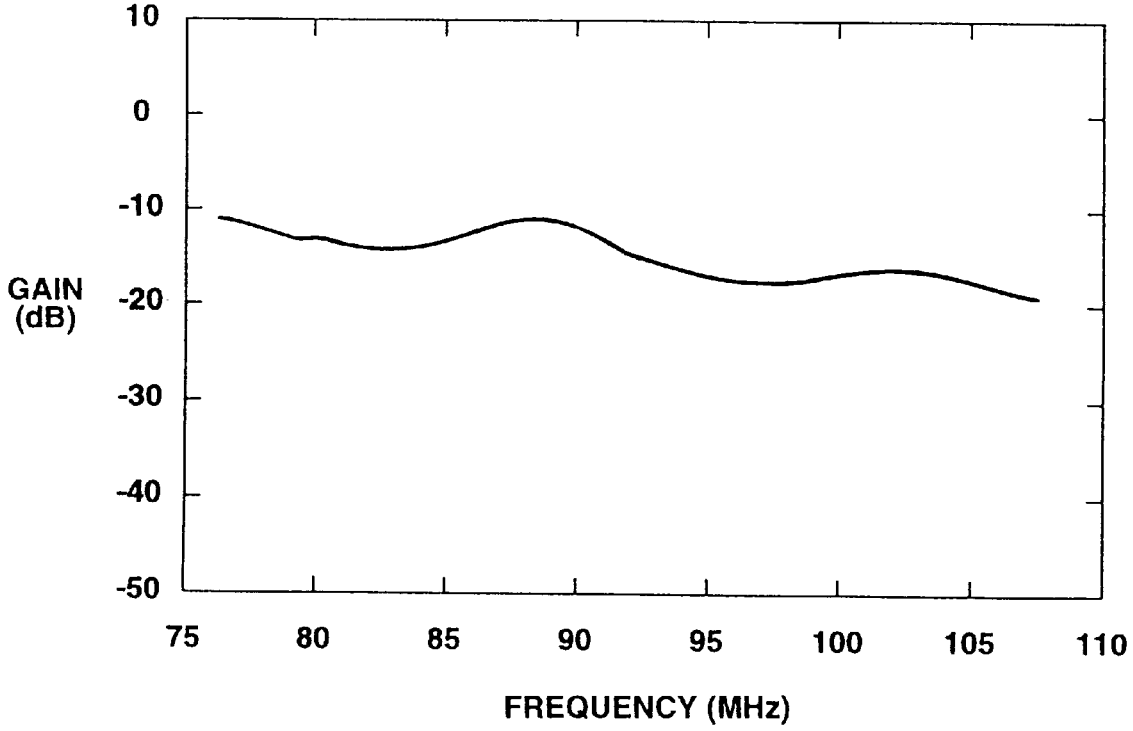

The frequency characteristic of the glass antenna system of this embodiment, which is representative of a reception gain for every frequency, is shown in the graph of FIG. 21. From this graph, it will be seen that the glass antenna system of this embodiment can attain a stably high gain in receiving a FM radio broadcast wave in the band of 76–90 MHz.

Further, it was recognized that the gain of the glass antenna system of this embodiment in receiving an AM radio broadcast wave in the band of 520–1620 KHz was nearly equal to that of the whip antenna.

Figure 11:
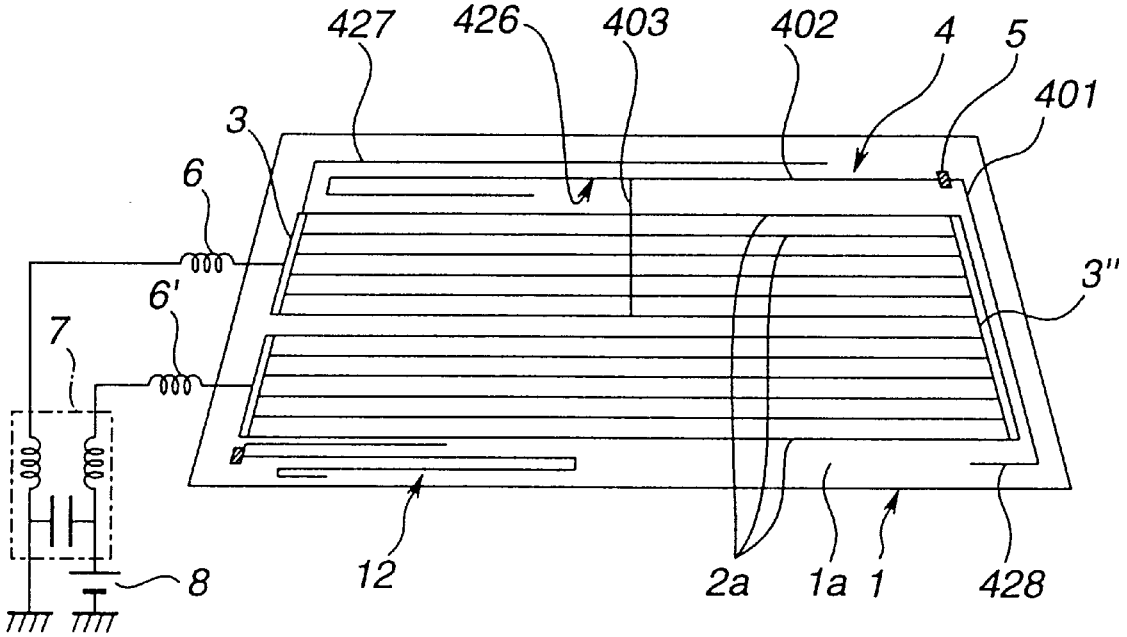

Referring to FIG. 11, a glass antenna system according to a further embodiment will be described.

In this embodiment, the dimensions of the window glass 1 is 1150 mm in the length A1 (refer to FIG. 8) of the upper edge, 1350 mm in the length A2 of the lower edge and 780 mm in the length B perpendicular to the upper and lower edges, the heating strips 2*a* are divided into two groups which are connected at one ends to the bus bars 3 and 3', respectively and at the other ends to the common bus bar 3", the smallest value of the distance D is set to 20 mm, and the glass antenna system includes auxiliary elements 426, 427 and 428 and is tuned to FM radio broadcast waves in the band of 76–90 MHz.

The antenna 4 in this embodiment includes a feed point 5 disposed in a widthwise marginal area of the space 1*a* above the heater element 2, a first vertical conductive strip 401 which is 450 mm long, 7 mm distant from the bus bar 3, and connected at an upper end thereof to the feed point 5, a horizontal conductive strip 402 which is 500 mm long, disposed in an area of the space 1*a* above the heater element 2 and connected at one of opposite ends thereof to the feed point 5, and a second vertical conductive strip 403 which is 200 mm long and connected at an upper end thereof to the other of the opposite ends of the horizontal conductive strip 402. The auxiliary element 426 is disposed in an area of the space 1*a* above the heater element 2 and consists of a pair of horizontal conductive strips and a vertical conductive strip parallel to the bus bar 3 and connecting between one ends of the horizontal conductive strips. Upper one of the horizontal conductive strip is 450 mm long and connected at the other end thereof to the junction between the horizontal conductive strip 402 and the vertical conductive strip 403 so as to extend in the direction of extension of same. Lower one of the horizontal conductive strips is 350 mm long, and the vertical conductive strip is 20 mm long. The auxiliary element 427 is disposed in an area of the space 1*a* above the heater element 2 and consists of a vertical conductive strip which is 60 mm long and connected at a lower end thereof to the bus bar 3 so as to extend in the direction of extension of the bus bar 3 and a horizontal conductive strip which is 920 mm long and connected at one end thereof to an upper end of the vertical conductive strip. The auxiliary element 428 is disposed in an area of the space 1*a* under the heater element 2 and consists of a horizontal conductive strip which is 100 mm long and connected at one end thereof to a lower end of the first vertical conductive strip 401.

The glass antenna system of this embodiment is further provided with an antenna 12 which is disposed in an area of the space 1*a* under the heater element 2 to serve as a subsidiary antenna. The bus bars 3 and 3' are connected to a DC power circuit, i.e., one 3' is connected through high frequency coil 6' and choke coil 7 to a DC power source 8 and the other 3 is grounded through a high frequency coil 6 and choke coil 7.

The gains of the glass antenna system of this embodiment in receiving a FM radio broadcast band wave in the band of 76–90 MHz and a FM radio broadcast band wave in the band of 88–108 MHz, with respect to horizontally polarized waves, were measured and compared with a standard dipole antenna for indication thereof by using the above described dipole ratio. The result was such that the average gains of the glass antenna system in receiving the above band waves were respectively −13.8 dB and −15.9 dB and thus higher than that of the whip antenna in receiving a wave in the band of 76–90 MHz to which this glass antenna system is tuned.

It is a matter of course that a desired or satisfactory gain in reception of FM radio broadcast waves can be attained by the use of the antenna 4 alone, but it is more preferable to additionally use the antenna 12 to carry out diversity reception.

Figure 12:
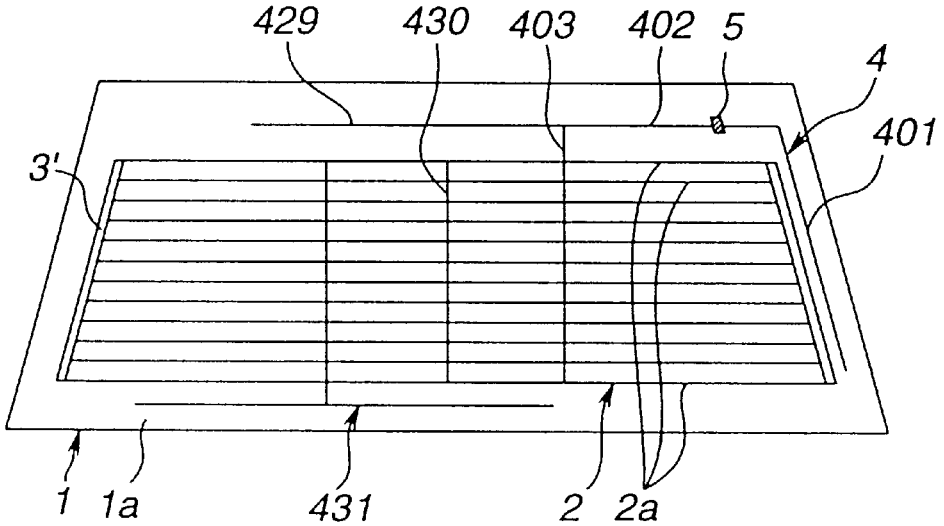

Referring to FIG. 12, a glass antenna system according to a further embodiment will be described.

In this embodiment, the smallest value of the distance D is set to 15 mm, and the glass antenna system is tuned to FM radio broadcast waves in the band of 88–108 MHz.

The antenna 4 in this embodiment includes a feed point 5 disposed in a widthwise marginal area of the space 1*a* above the heater element 2, a first vertical conductive strip 401 connected at the upper end thereof to the feed point 5, a horizontal conductive strip 402 disposed in an area of the space 1*a* above the heater element 2 and connected at one of opposite ends thereof to the feed point 5, and a second vertical conductive strip 403 connected at the upper end thereof to the other of the opposite ends of the horizontal conductive strip 402 and extending downwardly therefrom in a way as to intersect at right angles while being electrically connected to the heating strips 2*a* so as to have a lower end connected to the lowermost one of the heating strips 2*a*.

The glass antenna system is further provided with auxiliary elements 429, 430 and 431. The auxiliary element 429 consists of a horizontal conductive strip disposed in an area of the space 1*a* above the heater element 2 and connected at one end thereof to the junction between the horizontal conductive strip 402 and the second vertical conductive strip 403 so as to extend in the direction of extension of the horizontal conductive strip 402. The auxiliary element 430 consists of a vertical conductive strip extending between the uppermost one and lowermost one of the heating strips 2*a* in a way as to intersect at right angles while being electrically connected to the nearly the middle portions of the heating strips 2*a*. The auxiliary element 431 consists of a horizontal conductive strip disposed in an area of the space 1*a* under the heater element 2 and a vertical conductive strip connected at a lower end thereof to a nearly middle portion of the horizontal conductive strip and extending upwardly therefrom in a way as to intersect at right angles while being electrically connected to the horizontal conductive strips 2*a* so as to have an upper end connected to the uppermost one of the heating strips 2*a*. The vertical conductive strip of the auxiliary element 431 and the second vertical conductive strip 403 of the antenna 4 are disposed on the opposite sides of the auxiliary element 430.

The gains of the glass antenna system of this embodiment in receiving the above described FM radio waves in the band of 88–108 MHz were measured and compared with a standard dipole antenna for indication thereof by using the above described dipole ratio. The result was such that the average gain of the glass antenna system of this embodiment was 13.0 dB and far higher than that of the whip antenna.

Figure 13:
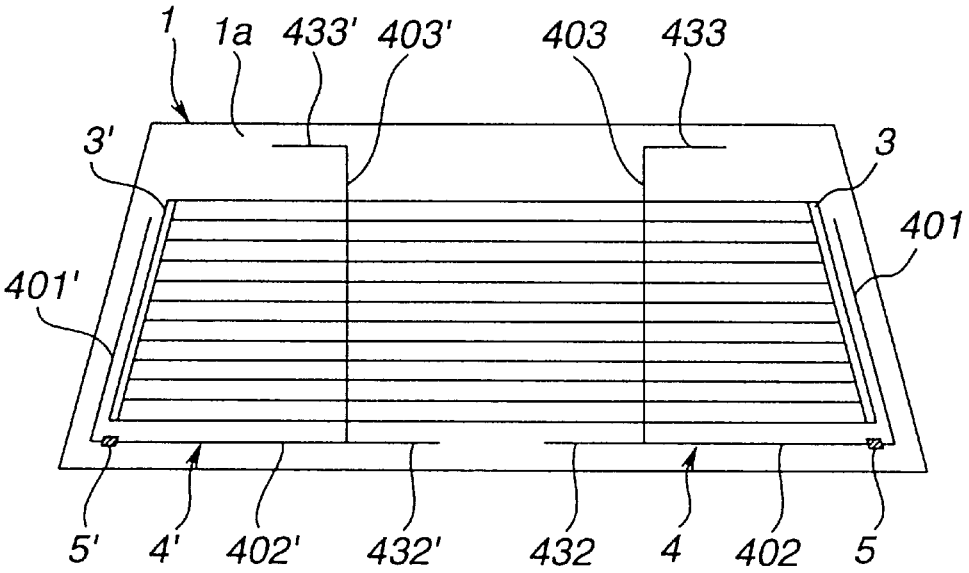

Referring to FIG. 13, a glass antenna system according to a further embodiment will be described.

The antenna 4 in this embodiment includes a feed point 5 disposed in a widthwise marginal area of the space 1*a* under the heater element 2, a first vertical conductive strip 401 connected at a lower end thereof to the feed point 5, a horizontal conductive strip 402 disposed in an area of the space 1*a* under the heater element 2 and connected at one of opposite ends thereof to the feed point 5, and a second vertical conductive strip 403 connected at a lower end thereof to the other of the opposite ends of the horizontal conductive strip 402 and extending upwardly therefrom in a way as to intersect at right angles while being electrically connected to the heating s trips 2*a* so as to have an upper end located above the uppermost one of the heating strips 2*a*.

The glass antenna system is further provided with auxiliary elements 432 and 433. The auxiliary element 432 is disposed in an area of the space 1*a* under the heater element 2 and consists of a horizontal conductive strip connected at one end to the junction between the horizontal conductive strip 402 and the second vertical conductive strip 403. The auxiliary element 433 is disposed in an area of the space 1*a* above the heater element 2 and consists of a horizontal conductive strip connected at one end to an upper end of the second vertical conductive strip 403.

The glass antenna system is further provided with an antenna 4'. The antennas 4 and 4' have symmetrical patterns or shapes with respect to a vertical axis extending through a widthwise central portion of the window glass 1 (i.e., a vertical axis with respect to which the window glass 1 is symmetrical). That is, the glass antenna 4' consists of a feed point 5' disposed in a widthwise marginal area of the space 1*a* under the heater element 2 and a first vertical conductive strip 401' connected at a lower end thereof to the feed point 5', a horizontal conductive strip 402' disposed in an area of the space 1*a* under the heater element 2 and connected at one of opposite ends thereof to the feed point 5', and a second vertical conductive strip 403' connected at a lower end thereof to the other of the ends of the horizontal conductive strip 402' and extending upwardly therefrom in a way as to intersect at right angles while being electrically connected to the heating strips 2*a* so as to have an upper end located above the uppermost one of the heating strips 2*a*. An auxiliary element 432' is disposed in an area of the space 1*a* under the heater element 2 and consists of a horizontal conductive strip connected at one end to the junction between the horizontal conductive strip 402' and the second vertical conductive strip 403'. An auxiliary element 433' consists of a horizontal conductive strip connected at one end thereof to the upper end of the second vertical conductive strip 403'.

Except for the above, this embodiment is substantially similar to the embodiment of FIG. 8 and can produce substantially the same effect. In the meantime, it is a matter of course that a desired or satisfactory gain in reception of FM radio broadcast waves can be attained by the use of the antenna 4 alone, but it is more preferable to additionally use the antenna 4' to carry out diversity reception.

Figure 14:
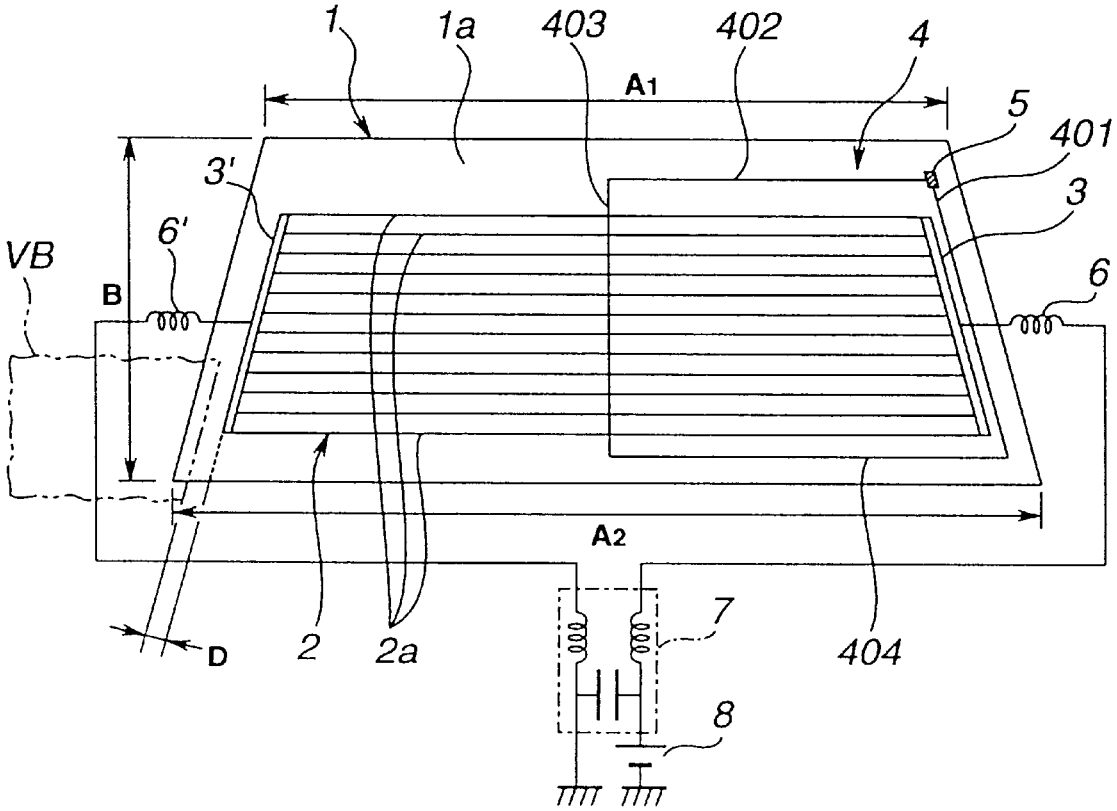

Referring to FIG. 14, a glass antenna system according to a further embodiment will be described.

In this embodiment, the window glass 1 is 1100 mm in the length A1 of the upper edge, 1350 mm in the length A2 of the lower edge and 520 mm in the length B perpendicular to the upper and lower edges. The smallest value of the distance D is set to 20 mm, and the glass antenna system is tuned to FM radio broadcast band waves in the band of 76–90 MHz in Japan.

The antenna 4 in this embodiment includes a feed point 5 disposed in a widthwise marginal area of the space above the heater element 2, a first vertical conductive strip 401 which is 400 mm long, 5 mm distant from the bus bar 3 and has an upper end connected to the feed point 5, a first horizontal conductive strip 402 which is 460 mm long, disposed in an area of the space 1*a* above the heater element 2 and connected at one of opposite ends thereof to the feed point 5, a second horizontal conductive strip 404 which is 580 mm long, disposed in an area of the space 1*a* under the heater element 2 and connected at one of opposite ends thereof to a lower end of the first vertical conductive strip 401, and a second vertical conductive strip 403 which is 370 mm long and connected at upper and lower ends thereof to the other ends of the first and second horizontal conductive strips 402 and 404, respectively while extending vertically so as to intersect at right angles and be electrically connected to the heating strips 2*a*.

The total length of the antenna 4 is 1810 mm and is therefore substantially equal to the resonance length in the FM radio broadcast band (76–90 MHz) in Japan.

Except for the above, this embodiment is substantially similar to the embodiment of FIG. 1.

The gains of the glass antenna system of this embodiment in receiving a FM radio broadcast band wave in the band of 76–90 MHz and a FM radio broadcast band wave in the band of 88–108 MHz, with respect to horizontally polarized waves, were measured and compared with a standard dipole antenna for indication thereof by using the above described dipole ratio. The result was such that the average gains of the glass antenna system in receiving the above described band waves were respectively −11.9 dB and −16.2 dB. In contrast to this, the corresponding average gains of a comparable whip antenna were respectively about −15 dB and about −16 dB. Considering that the gain of the glass antenna system of this embodiment is far higher in receiving a wave in the band of 76–90 MHz, the glass antenna system of this embodiment is judged to be a considerably good antenna for reception of FM radio broadcast band waves.

Figure 22:
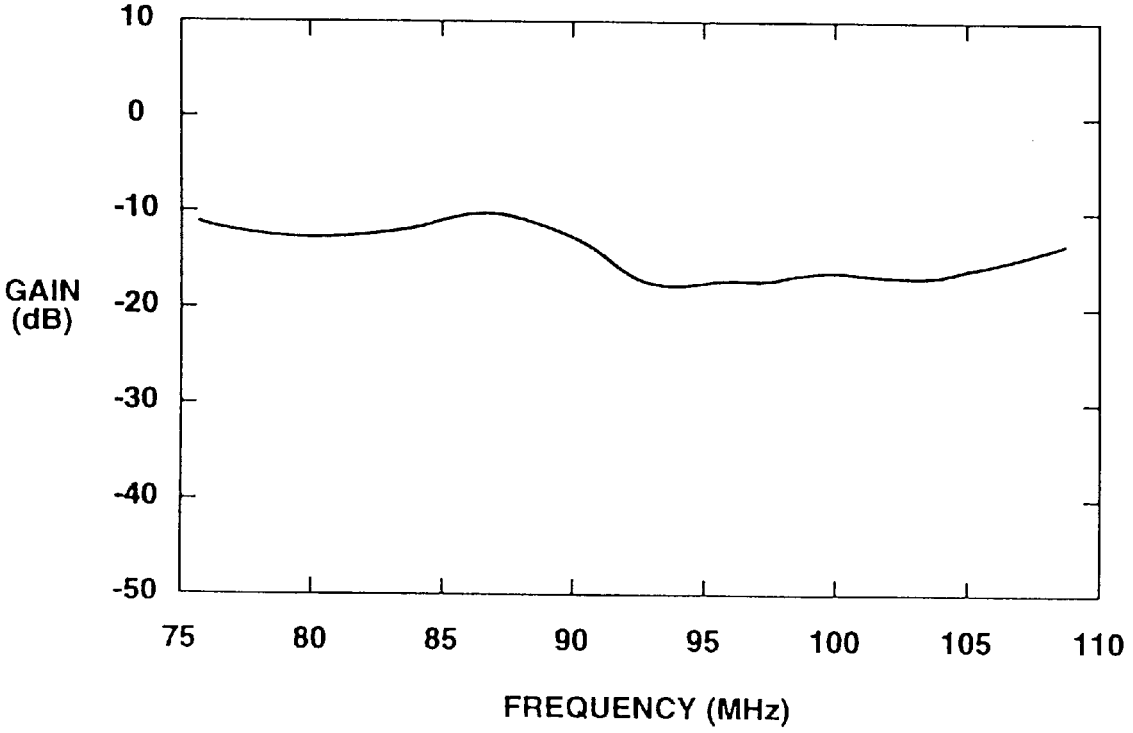

The frequency characteristic of the glass antenna system of this embodiment, which is representative of a reception gain for every frequency, is shown in the graph of FIG. 22. From this graph, it will be seen that the glass antenna system of this embodiment can attain a stably high reception gain for any band wave.

In the meantime, it was confirmed that the gain of the glass antenna system of this embodiment in receiving a TV broadcast wave was nearly equal to that of a glass antenna usually used for receiving a TV broadcast wave.

Further, it was recognized that the gains of the glass antenna system of this embodiment in receiving AM radio broadcast band waves of 520–1620 KHz were nearly equal to those of the whip antenna.

Figure 27:
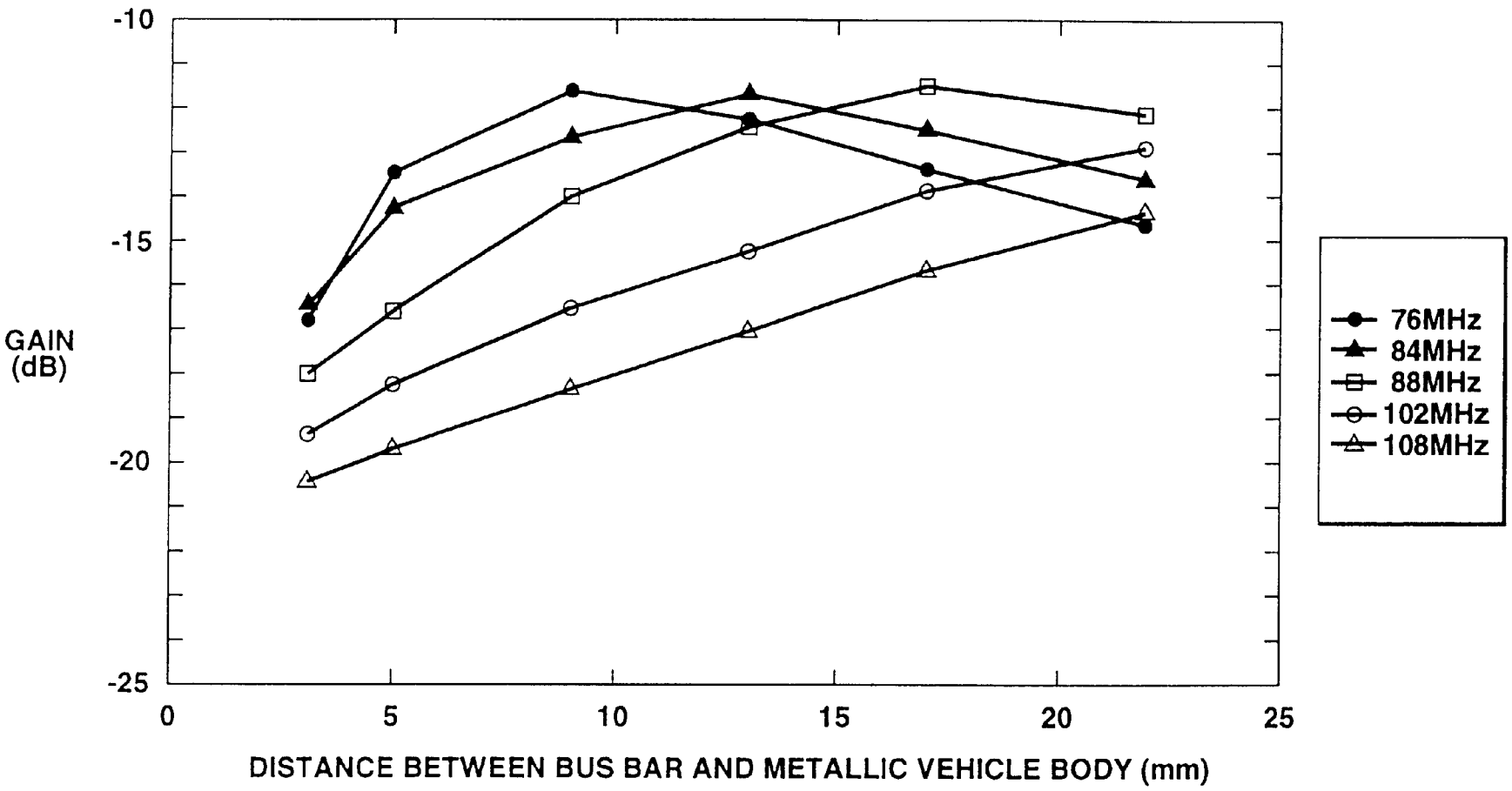

The graph of FIG. 27 shows how the reception gain of the glass antenna system of FIG. 1 in receiving FM radio broadcast waves varies with the distance D between the bus bar 3 or 3' and the metallic body portion VB such as a panel flange. From this graph, it will be seen that the average gain of the glass antenna system in receiving FM radio broadcast waves generally becomes higher as the distance D becomes larger.

Figure 15:
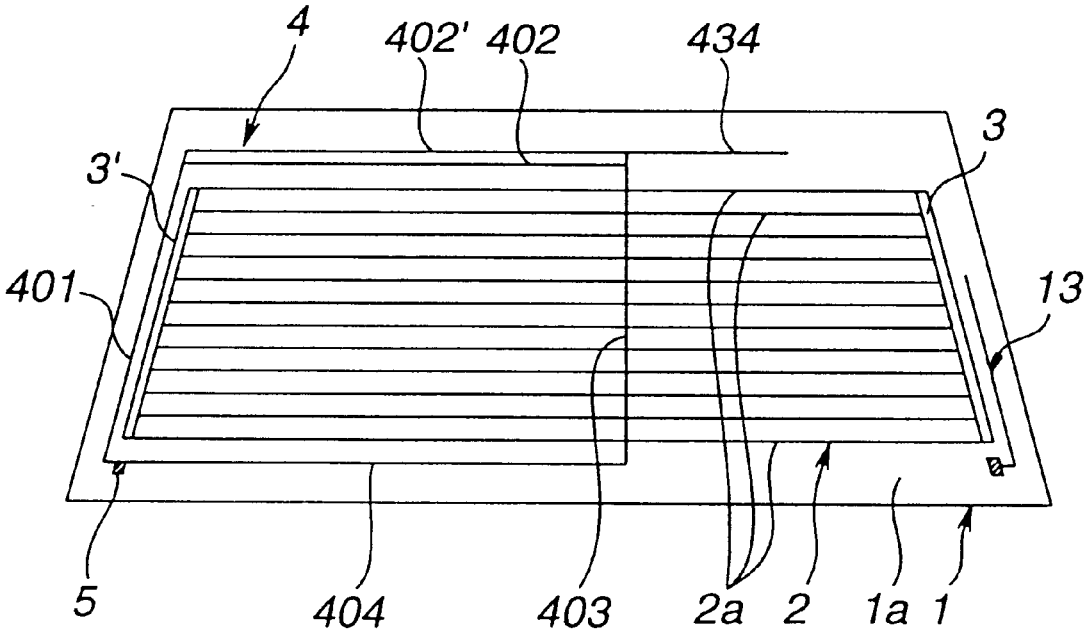

Referring to FIG. 15, a glass antenna system according to a further embodiment of the present invention will be described.

In this embodiment, the smallest value of the distance D is set to 20 mm, and the glass antenna system includes doubled first horizontal conductive strips 402 and 402' and an auxiliary elements 434 and is tuned to FM radio broadcast waves in the band of 76–90 MHz.

The antenna 4 in this embodiment includes a feed point 5 disposed in a widthwise marginal area of the space 1*a* under the heater element 2, a first vertical conductive strip 401 which is 400 mm long, 5 mm distant from the bus bar 3' and connected at a lower end thereof to the feed point 5, a pair of parallel, first horizontal conductive strips 402 and 402' which are respectively 565 mm and 560 mm long and connected at one ends to an upper end portion of the first vertical conductive strip 401, a second horizontal conductive strip 404 which is 680 mm long, disposed in an area of the space 1*a* under the heater element 2 and connected at one of opposite ends thereof to the feed point 5, and a second vertical conductive strip 403 which is 370 mm long and connected at upper and lower ends thereof to the other ends of the pair of first horizontal conductive strips 402 and 402' and the second horizontal conductive strip 404, respectively while extending vertically in a way as to intersect at right angles and be electrically connected to the heating strips 2*a*. The auxiliary element 434 consists of a horizontal conductive strip which is 300 mm long, disposed in the area of the space 1*a* above the heater element 2 and connected at one end thereof to the junction between the upper one 402' of the first horizontal conductive strips and the second vertical conductive strip 403 in a way as to extend in the direction of extension of the upper one 402' of the first horizontal conductive strips. The antenna 4 thus has a looped shape or pattern.

The glass antenna system is further provided with an antenna 13 for reception of FM radio broadcast band waves. The antenna 13 consists of a feed point disposed in a widthwise marginal area of the space 1*a* under the heater element 2 and a vertical conductive strip connected at a lower end thereof to the feed point 5.

Except for the above, this embodiment is substantially similar to the embodiment of FIG. 14. In the meantime, the DC power circuit is omitted in FIG. 14 for brevity.

The gains of the glass antenna system of this embodiment in receiving a FM radio broadcast band wave in the band of 76–90 MHz and a FM radio broadcast band wave in the band of 88–108 MHz, with respect to horizontally polarized waves, were measured and compared with a standard dipole antenna for indication thereof by using the above described dipole ratio. The result was such that the average gains of the glass antenna system in receiving the above band waves were respectively −12.6 dB and −17.4 dB and thus far higher than that of the whip antenna in receiving a wave in the band of 76–90 MHz.

Further, it was recognized that the gains of the glass antenna system of this embodiment in receiving AM radio broadcast band waves of 520–1620 KHz were nearly equal to those of the whip antenna.

Figure 16:
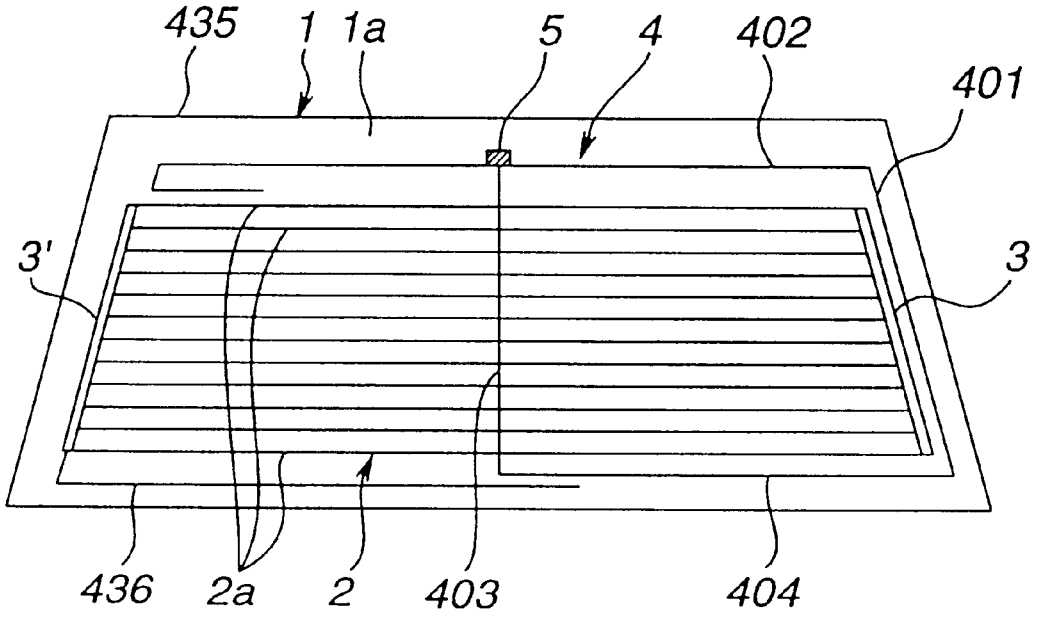

Referring to FIG. 16, a glass antenna system according to a further embodiment will be described.

In this embodiment, the dimensions of the window glass 1 is 950 mm in the length A1 (refer to FIG. 14) of the upper edge, 1120 mm in the length A2 of the lower edge and 540 mm in the length B perpendicular to the upper and lower edges, the feed point 5 is disposed in a widthwise central area of the space 1*a* above the heater element 2, the smallest value of the distance D is set to 15 mm, and the glass antenna system includes auxiliary elements 435 and 436, and is tuned to FM radio broadcast waves in the band of 88–108 MHz.

The antenna 4 in this embodiment includes a first vertical conductive strip 401 which is 370 mm long and 2 mm distant from the bus bar 3, a first horizontal conductive strip 402 which is 420 mm long, disposed in an area of the space 1*a* above the heater element 2 and connected at one of opposite ends thereof an upper end of the first vertical conductive strip 401 and the other end connected to the feed point 5, a second horizontal conductive strip 404 which is 500 mm long, disposed in an area of the space 1*a* under the heater element 2 and connected at one of opposite ends thereof to a lower end of the first vertical conductive strip 401, and a second vertical conductive strip 403 which is 340 mm long and connected at upper and lower ends thereof to the other ends of the first and second horizontal conductive strips 402 and 404, respectively. The second vertical conductive strip 403 extends vertically in a way as to intersect at right angles while being electrically connected to the heating strips 2*a*. The auxiliary element 435 is disposed in an area of the space 1*a* above the heater element 2 and consists of a pair of horizontal conductive strips and a vertical conductive strip connecting between one ends of the horizontal conductive strips. Upper one of the horizontal conductive strips is 420 mm long and connected at one end to the feed point 5 in a way as to extend in the direction of extension of the first horizontal conductive strip 402, lower one of the horizontal conductive strips is 180 mm long, and the vertical conductive strip is 30 mm long. The auxiliary element 436 is disposed in an area of the space 1*a* under the heater element 2 and consists of a vertical conductive strip which is 40 mm long and connected at an upper end thereof to the lower end of the bus bar 3' in a way as to extend in the direction of extension of the bus bar 3' and a horizontal conductive strip which is 740 mm long and connected at one end thereof to a lower end of the vertical conductive strip. In the meantime, the auxiliary element 436 may be connected to one of the heating strips 2*a*.

Except for the above, this embodiment is substantially similar to the embodiment of FIG. 14. In the meantime, the DC power circuit is omitted in FIG. 16 for brevity.

The gains of the glass antenna system of this embodiment in receiving a FM radio broadcast band wave in the band of 76–90 MHz and a FM radio broadcast band wave in the band of 88–108 MHz, with respect to horizontally polarized waves, were measured and compared with a standard dipole antenna for indication thereof by using the above described dipole ratio. The result was such that the average gains of the glass antenna system in receiving the above band waves were respectively −15.4 dB and −13.7 dB and thus far higher than that of the whip antenna in receiving a wave in the band of 88–108 MHz to which the glass antenna system of this embodiment is tuned.

Figure 23:
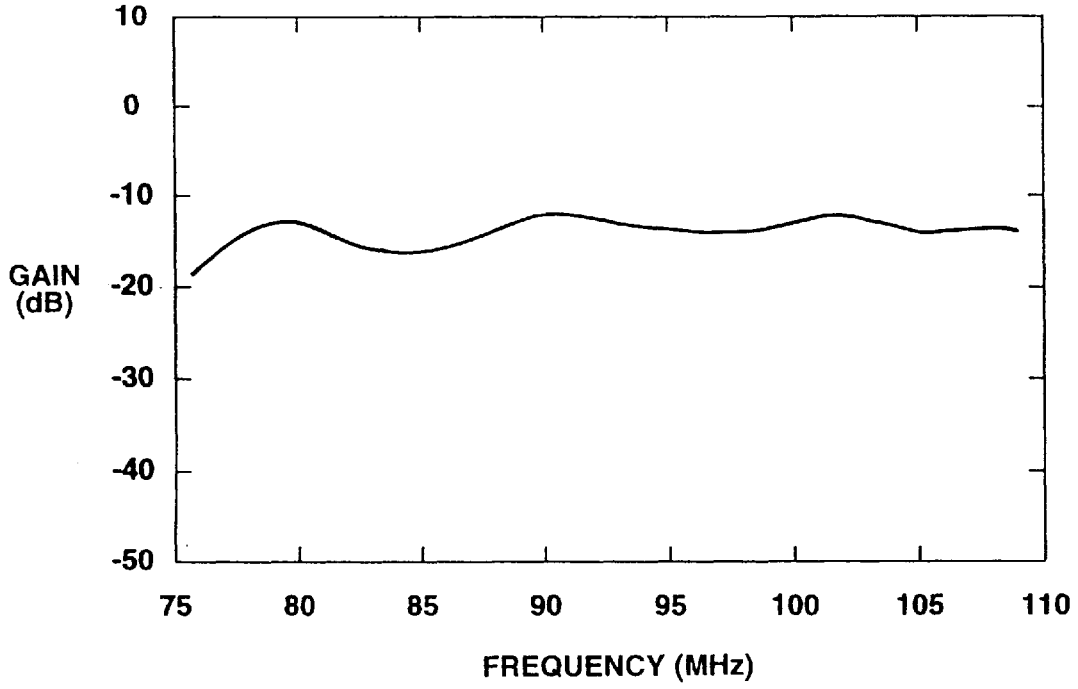

The frequency characteristic of the glass antenna system of this embodiment, which is representative of a reception gain for every frequency, is shown in the graph of FIG. 23. From this graph, it will be seen that the glass antenna system of this embodiment can attain a stably high gain in receiving a FM radio broadcast wave in the band of 88–108 MHz.

Further, it was recognized that the gain of the glass antenna system of this embodiment in receiving an AM radio broadcast band wave in the band of 520–1620 KHz was nearly equal to that of the whip antenna.

Figure 17:
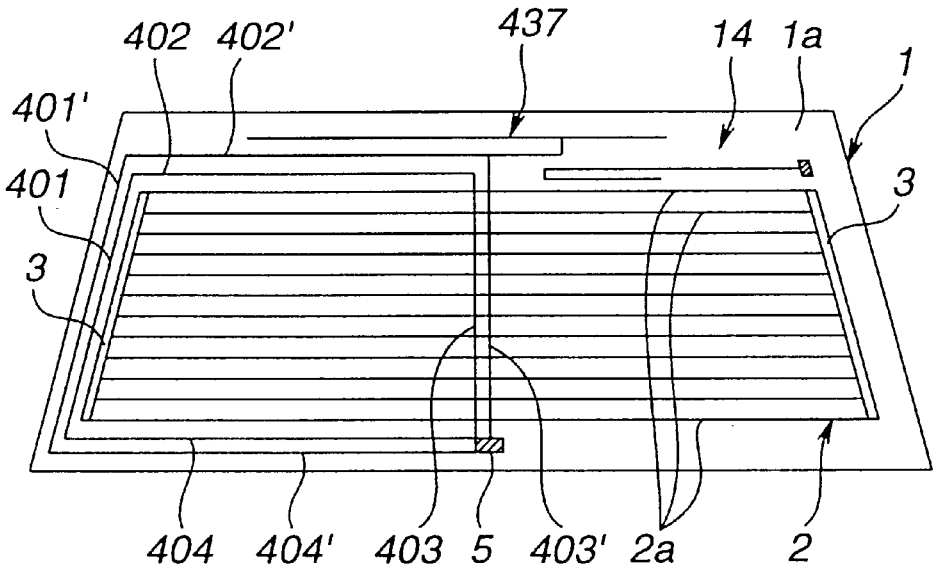

Referring to FIG. 17, a glass antenna system according to a further embodiment will be described.

In this embodiment, the feed point 5 is disposed in a widthwise central portion of the space 1*a* under the heater element 2, the smallest value of the distance D is set to 12 mm, the glass antenna system includes a pair of first vertical conductive strips, a pair of first horizontal conductive strips, a pair of second vertical conductive strips and a pair of second horizontal conductive strips, which are all arranged double, and the glass antenna system further includes an auxiliary element 437 and is tuned to FM radio broadcast waves in the band of 76–90 MHz.

More specifically, the antenna 4 in this embodiment includes a pair of first vertical conductive strips 401 and 401' which are respectively 410 mm and 450 mm long, disposed in an area of the space 1*a* between the bus bar 3' and a lateral edge of the window glass 1 and respectively 2 mm and 3 mm distant from the bus bar 3', a pair of first horizontal conductive strips 402 and 402' which are respectively 550 mm and 570 mm long, disposed in an area of the space 1*a* above the heater element 2 and connected at one ends thereof to the upper ends of the first vertical conductive strips 401 and 401', a pair of second horizontal conductive strips 404 and 404' which are respectively 600 mm and 620 mm long, disposed in an area of the space 1*a* under the heater element 2 and connected at one ends thereof to the lower ends of the first vertical conductive strips 401 and 401', and a pair of second vertical conductive strips 403 and 403' which are respectively 390 mm and 410 mm long and connected at upper ends thereof to the other ends of the first horizontal conductive strips 402 and 402' and at lower ends thereof to the other ends of the second horizontal conductive strips 404 and 404'. The second vertical conductive strips 403 and 403' extend vertically in a way as to intersect at right angles while being electrically connected to the heating strips 2*a*. The glass antenna system of this embodiment thus has a double-looped shape or pattern. The auxiliary element 437 is disposed in the area of the space 1*a* above the heater element 2 and consists of a lower horizontal conductive strip which is 200 mm long and connected at one of opposite ends thereof to the junction between outer one 402' of the first horizontal conductive strips and outer one 403' of the second vertical conductive strips in a way as to extend in the direction of extension of outer one 402' of the first horizontal conductive strips, a short vertical conductive strip connected to the other of the opposite ends of the lower horizontal conductive strip, and an upper horizontal conductive strip which is 700 mm long and having a point intermediate between opposite ends thereof where it is connected to the upper end of the vertical conductive strip.

The glass antenna system of this embodiment is further provided with a subsidiary antenna 14 for reception of FM radio broadcast band waves. The subsidiary antenna 14 is disposed in an area of the space above the heater element 2 and consists of a feed point disposed in an widthwise marginal area of the space 1*a* above the heater element 2, a pair of horizontal conductive strips and one vertical conductive strips connecting between one ends of the horizontal conductive strip, the upper one of the horizontal conductive strips being longer and having the other end connected to the feed point.

Except for the above, this embodiment is substantially similar to the embodiment of FIG. 14. In the meantime, the DC power circuit is omitted in FIG. 17 for brevity.

The gains of the glass antenna system of this embodiment in receiving a FM radio broadcast band wave in the band of 76–90 MHz and a FM radio broadcast band wave in the band of 88–108 MHz, with respect to horizontally polarized waves, were measured and compared with a standard dipole antenna for indication thereof by using the above described dipole ratio. The result was such that the average gains of the glass antenna system in receiving the above band waves were respectively −12.2 dB and −18.1 dB and thus far higher than that of the whip antenna in receiving a wave in the band of 76–90 MHz to which the glass antenna system of this embodiment is tuned.

It is a matter of course that a desired or sufficient gain in reception of FM radio broadcast waves can be attained by the use of the antenna 4 alone, but it is more preferable to additionally use the antenna 10 to carry out diversity reception.

What is claimed is:

1. A glass antenna system attached to a vehicle rear window glass for receiving FM and AM radio broadcast waves, comprising:

a defogging heater element disposed on the rear window glass in a way as to leave a space therearound;

said defogging heater element including a plurality of heating strips and a pair of bus bars; and an antenna having a feed point disposed in a widthwise marginal area of said space under said heater element, a first vertical conductive strip disposed in an area of said space between one of said bus bars and a lateral edge of said window glass and connected at a lower end thereof to said feed point, a horizontal conductive strip disposed in an area of said space above said heater element and connected at one of opposite ends thereof to an upper end of said first vertical conductive strip, and a second vertical conductive strip connected at an upper end thereof to the other of said opposite ends of said horizontal conductive strip and extending downwardly therefrom in a way as to intersect at right angles while being electrically connected to said heating strips.

2. The glass antenna system according to claim 1, further comprising an auxiliary element connected to one of said heating strips.

3. The glass antenna system according to claim 1, further comprising an auxiliary element connected to one of said bus bars.

4. The glass antenna system according to claim 1, further comprising an auxiliary element connected to said horizontal conductive strip.

5. The glass antenna system according to claim 1, further comprising a plurality of auxiliary elements each including a vertical conductive strip disposed in a way as to intersect at right angles while being electrically connected to said heating strips.

6. The glass antenna system according to claim 1, wherein the distance between said first vertical conductive strip and one of said bus bars is in the range from 1 mm to 10 mm.

7. The glass antenna system according to claim 1, wherein the distance between said bus bars and an adjacent metallic vehicle body portion is set to 5 mm or larger for reception of a FM radio broadcast wave in the band of 76–90 MHz.

8. The glass antenna system according to claim 1, wherein the distance between said bus bars and an adjacent metallic vehicle body portion is set to 10 mm or larger for reception of a FM radio broadcast wave in the band of 88–108 MHz.

9. The glass antenna system according to claim 1, wherein said bus bars are connected a DC power source by way of high frequency coils and choke coils.

10. The glass antenna system according to claim 1, further comprising a second antenna, said first mentioned antenna and said second antenna being symmetrical with respect to a vertical axis extending through a widthwise central portion of said window glass.

11. An glass antenna system attached to a vehicle rear window glass for receiving FM and AM radio broadcast waves, comprising:

a defogging heater element disposed on the rear window glass in a way as to leave a space therearound;

said defogging heater element including a plurality of heating strips and a pair of bus bars; and an antenna having a feed point disposed in a widthwise marginal area of said space above said heater element, a first vertical conductive strip disposed in an area of said space between one of said bus bars and a lateral edge of said window glass and connected at an upper end thereof to said feed point, a horizontal conductive strip disposed in an area of said space under said heater element and connected at one of opposite ends thereof to a lower end of said first vertical conductive strip, and a second vertical conductive strip connected at one of opposite ends thereof to the other of said opposite ends of said horizontal conductive strip and extending upwardly therefrom in a way as to intersect at right angles while being electrically connected to said heating strips.

12. The glass antenna system according to claim 11, further comprising an auxiliary element connected to one of said heating strips.

13. The glass antenna system according to claim 11, further comprising an auxiliary element connected to one of said bus bars.

14. The glass antenna system according to claim 11, further comprising an auxiliary element connected to said horizontal conductive strip.

15. The glass antenna system according to claim 11, further comprising a plurality of auxiliary elements each including a vertical conductive strip disposed in a way as to intersect at right angles while being electrically connected to said heating strips.

16. The glass antenna system according to claim 11, wherein the distance between said first vertical conductive strip and one of said bus bars is in the range from 1 mm to 10 mm.

17. The glass antenna system according to claim 11, wherein the distance between said bus bars and an adjacent metallic vehicle body portion is set to 5 mm or larger for reception of a FM radio broadcast wave in the band of 76–90 MHz.

18. The glass antenna system according to claim 11, wherein the distance between said bus bars and an adjacent metallic vehicle body portion is set to 10 mm or larger for reception of a FM radio broadcast wave in the band of 88–108 MHz.

19. The glass antenna system according to claim 11, wherein said bus bars are connected to a DC power source by way of high frequency coils and choke coils.

20. The glass antenna system according to claim 11, further comprising a second antenna, said first mentioned antenna and said second antenna being symmetrical with respect to a vertical axis extending through a widthwise central portion of said window glass.

21. An glass antenna system attached to a vehicle rear window glass for receiving FM and AM radio broadcast waves, comprising:

a defogging heater element disposed on the rear window glass in a way as to leave a space therearound;

said defogging heater element including a plurality of heating strips and a pair of bus bars; and an antenna having a feed point disposed in a widthwise marginal area of said space under said heater element, a first vertical conductive strip disposed in an area of said space between one of said bus bars and a lateral edge of said window glass and connected at a lower end thereof to said feed point, a horizontal conductive strip disposed in an area of said space under said heater element and connected at one of opposite ends thereof to said feed point, and a second vertical conductive strip having a lower end connected to the other of said opposite ends of said horizontal conductive strip and extending upwardly therefrom in a way as to intersect at right angles while being electrically connected to said heating strips.

22. The glass antenna according to claim 21, further comprising an auxiliary element connected to said second vertical conductive strip.

23. The glass antenna system according to claim 21, further comprising an auxiliary element connected to one of said heating strips.

24. The glass antenna system according to claim 21, further comprising an auxiliary element connected to one of said bus bars.

25. The glass antenna system according to claim 21, further comprising an auxiliary element connected to said horizontal conductive strip.

26. The glass antenna system according to claim 21, further comprising a plurality of auxiliary elements each including a vertical conductive strip disposed as to intersect at right angles while being electrically connected to said heating strips.

27. The glass antenna system according to claim 21, wherein the distance between said first vertical conductive strip and of said bus bars is in the range from 1 mm to 10 mm.

28. The glass antenna system according to claim 21, wherein the distance between said bus bars and an adjacent metallic vehicle body portion is set to 5 mm or larger for reception of a FM radio broadcast wave in the band of 76–90 MHz.

29. The glass antenna system according to claim 21, wherein the distance between said bus bars and an adjacent metallic vehicle body portion is set to 10 mm or larger for reception of a FM radio broadcast wave in the band of 88–108 MHz.

30. The glass antenna system according to claim 21, wherein said bus bars are connected a DC power source by way of high frequency coils and choke coils.

31. The glass antenna system according to claim 21, further comprising a second antenna, said first mentioned antenna and said second antenna being symmetrical with respect to a vertical axis extending through a widthwise central portion of said window glass.

32. A glass antenna system attached to a vehicle rear window glass for receiving FM and AM radio broadcast waves, comprising:

a defogging heater element disposed on the rear window glass in a way as to leave a space therearound;

said defogging heater element including a plurality of heating strips and a pair of bus bars; and an antenna having a feed point disposed in a widthwise marginal area of said space above said heater element, a first vertical conductive strip disposed in an area of said space between one of said bus bars and a lateral edge of said window glass and connected at an upper end thereof to said feed point, a horizontal conductive strip disposed in an area of said space above said heater element and connected at one of opposite ends thereof to said feed point, and a second vertical conductive strip having an upper end connected to the other of said opposite ends of said horizontal conductive strip and extending downwardly therefrom in a way as to intersect at right angles while being electrically connected to said heating strips.

33. The glass antenna according to claim 32, further comprising an auxiliary element connected to said second vertical conductive strip.

34. The glass antenna system according to claim 32, further comprising an auxiliary element connected to one of said heating strips.

35. The glass antenna system according to claim 32, further comprising an auxiliary element connected to one of said bus bars.

36. The glass antenna system according to claim 32, further comprising an auxiliary element connected to said horizontal conductive strip.

37. The glass antenna system according to claim 32, further comprising a plurality of auxiliary elements each including a vertical conductive strip disposed in a way as to intersect at right angles while being electrically connected to said heating strips.

38. The glass antenna system according to claim 32, wherein the distance between said first vertical conductive strip and one of said bus bars is in the range from 1 mm to 10 mm.

39. The glass antenna system according to claim 32, wherein the distance between said bus bars and an adjacent metallic vehicle body portion is set to 5 mm or larger for reception of a FM radio broadcast wave in the band of 76–90 MHz.

40. The glass antenna system according to claim 32, wherein the distance between said bus bars and an adjacent metallic vehicle body portion is set to 10 mm or larger for reception of a FM radio broadcast wave in the band of 88–108 MHz.

41. The glass antenna system according to claim 32, wherein said bus bars are connected to a DC power source by way of high frequency coils and choke coils.

42. The glass antenna system according to claim 32, further comprising a second antenna, said first mentioned antenna and said second antenna being symmetrical with respect to a vertical axis extending through a widthwise central portion of said window glass.

43. A glass antenna system attached to a vehicle rear window glass for receiving FM and AM radio broadcast waves, comprising:

a defogging heater element disposed on the rear window glass in a way as to leave a space therearound;

said defogging heater element including a plurality of heating strips and a pair of bus bars; and an antenna having a first vertical conductive strip disposed in an area of said space between one of said bus bars and a lateral edge of said window glass, a first horizontal conductive strip disposed in an area of said space above said heater element and connected at one of opposite ends thereof to an upper end of said first vertical conductive strip, a second horizontal conductive strip disposed in an area of said space under said heater element and connected at one of opposite ends thereof to a lower end of said first vertical conductive strip, a second vertical conductive strip having an upper end connected to the other of said opposite ends of said first horizontal conductive strip and a lower end connected to the other of said opposite ends of said second horizontal conductive strip, said second vertical conductive strip extending vertically in a way as to intersect at right angles while being electrically connected to said heating strips, and a feed point attached to at least one of said first vertical conductive strip, said first horizontal conductive strip, said second vertical conductive strip and said second horizontal conductive strip.

44. The glass antenna system according to claim 43, further comprising an auxiliary element connected to one of said heating strips.

45. The glass antenna system according to claim 43, further comprising an auxiliary element connected to one of said bus bars.

46. The glass antenna system according to claim 43, further comprising an auxiliary element connected to said horizontal conductive strip.

47. The glass antenna system according to claim 43, further comprising a plurality of auxiliary elements each including a vertical conductive strip disposed in a way as to intersect at right angles while being electrically connected to said heating strips.

48. The glass antenna system according to claim 43, wherein the distance between said first vertical conductive strip and one of said bus bars is in the range from 1 mm to 10 mm.

49. The glass antenna system according to claim 43, wherein the distance between said bus bars and an adjacent metallic vehicle body portion is set to 5 mm or larger for reception of a FM radio broadcast wave in the band of 76–90 MHz.

50. The glass antenna system according to claim 43, wherein the distance between said bus bars and an adjacent metallic vehicle body portion is set to 10 mm or larger for reception of a FM radio broadcast wave in the band of 88–108 MHz.

51. The glass antenna system according to claim 43, wherein said bus bars are connected a DC power source by way of high frequency coils and choke coils.

52. The glass antenna system according to claim 43, wherein said antenna further includes a conductive strip parallel to one of said first vertical conductive strip, said first horizontal conductive strip, said second vertical conductive strip and said second vertical conductive strip such that said antenna is partly double-looped.

53. The glass antenna system according to claim 43, wherein said antenna further includes a plurality of conductive strips which are respectively parallel to said first vertical conductive strip, said first horizontal conductive strip, said second horizontal conductive strip and said second vertical conductive strip such that said antenna is double-looped.

* * * * *